US008550732B2

(12) United States Patent
Onozato

(10) Patent No.: US 8,550,732 B2
(45) Date of Patent: Oct. 8, 2013

(54) INTERMEDIATE TRANSFER MEDIUM CONVEYING DEVICE AND THERMAL TRANSFER LINE PRINTER USING THE SAME

(75) Inventor: Takashi Onozato, Miyagi-Ken (JP)

(73) Assignee: Alps Electric Co., Ltd., Tokyo (JP)

( * ) Notice: Subject to any disclaimer, the term of this patent is extended or adjusted under 35 U.S.C. 154(b) by 295 days.

(21) Appl. No.: 13/011,253

(22) Filed: Jan. 21, 2011

(65) Prior Publication Data

US 2011/0180648 A1 Jul. 28, 2011

(30) Foreign Application Priority Data

Jan. 22, 2010 (JP) ..... 2010-011891

(51) Int. Cl.
*B41J 33/00* (2006.01)
*B41J 33/16* (2006.01)

(52) U.S. Cl.
USPC ..... 400/236; 400/221; 400/223; 400/120.01; 400/120.02; 347/213

(58) Field of Classification Search
USPC ..... 400/236
See application file for complete search history.

(56) References Cited

U.S. PATENT DOCUMENTS

| | | | | |
|---|---|---|---|---|
| 4,973,985 | A * | 11/1990 | Genno et al. | 347/217 |
| 6,142,686 | A * | 11/2000 | Schanke et al. | 400/234 |
| 6,639,618 | B2 * | 10/2003 | Nakamura et al. | 347/213 |
| 7,907,872 | B2 * | 3/2011 | Komatsu et al. | 399/167 |
| 2003/0026635 | A1 | 2/2003 | Tsuruta et al. | |
| 2006/0216097 | A1 * | 9/2006 | Ono | 400/225 |
| 2007/0086821 | A1 * | 4/2007 | Suzuki et al. | 400/76 |
| 2008/0049091 | A1 | 2/2008 | Nishitani et al. | |
| 2009/0317162 | A1 * | 12/2009 | Bandholz et al. | 400/221 |

FOREIGN PATENT DOCUMENTS

| | | | |
|---|---|---|---|
| EP | 0 930 171 | | 7/1999 |
| EP | 1 258 365 | | 11/2002 |
| JP | 61116569 | A * | 6/1986 |
| JP | 62041070 | A * | 2/1987 |
| JP | 62207665 | A * | 9/1987 |
| JP | 01267080 | A * | 10/1989 |
| JP | 02263673 | A * | 10/1990 |
| JP | 04010971 | A * | 1/1992 |

(Continued)

OTHER PUBLICATIONS

Extended European Search Report for European Application No. 10194583.0 mailed Apr. 18, 2011.

*Primary Examiner* — Ren Yan
*Assistant Examiner* — Nguyen Q Ha
(74) *Attorney, Agent, or Firm* — Hunton & Williams LLP

(57) ABSTRACT

An intermediate transfer medium conveying device conveys an intermediate transfer medium by a drive force of one DC motor, in a normal feed direction where the intermediate transfer medium is wound on a winding reel and in a reverse feed direction where the intermediate transfer medium is wound on a feeding reel. The intermediate transfer medium conveying device includes a winding shaft that drives the winding reel during normal feed where the intermediate transfer medium is conveyed in the normal feed direction, a feeding shaft driving the feeding reel during reverse feed where the intermediate transfer medium is conveyed in the reverse feed direction, transmission means for normal feed that transmits a drive force of the DC motor to the winding shaft during the normal feed, and transmission means for reverse feed that transmits a drive force of the DC motor to the feeding shaft during the reverse feed.

5 Claims, 11 Drawing Sheets

(56) References Cited

FOREIGN PATENT DOCUMENTS

| | | | | |
|---|---|---|---|---|
| JP | 04353469 | A | * | 12/1992 |
| JP | 06344615 | A | * | 12/1994 |
| JP | 08332742 | A | * | 12/1996 |
| JP | 2002-147499 | | | 5/2002 |
| JP | 2002-337373 | | | 11/2002 |
| JP | 2002-337410 | | | 11/2002 |
| JP | 2007-112007 | | | 5/2007 |

* cited by examiner

INTERMEDIATE TRANSFER MEDIUM CONVEYING DEVICE AND THERMAL TRANSFER LINE PRINTER USING THE SAME

CROSS REFERENCE TO RELATED APPLICATION

The present invention contains subject matter related to and claims the benefit of Japanese Patent Application No. 2010-011891 filed in the Japanese Patent Office on Jan. 22, 2010, the entire contents of which is incorporated herein by reference.

BACKGROUND OF THE DISCLOSURE

1. Technical Field

Embodiments of the present disclosure relate to an intermediate transfer medium conveying device suitable for conveying a belt-like intermediate transfer medium, which is wound between a winding reel and a feeding reel, by the drive force of one DC motor in a normal feed direction where the intermediate transfer medium is wound on the winding reel and in a reverse feed direction where the intermediate transfer medium is wound on the feeding reel; and a thermal transfer line printer using the intermediate transfer medium conveying device.

2. Related Art

An intermediate transfer type thermal transfer line printer, which forms a primary image by transferring ink of a multi-color ink film to an intermediate transfer medium by a line thermal head and forms an image on a medium to be transferred by re-transferring the primary image to the medium to be transferred by re-transfer means, can easily form an image on various media to be transferred, such as a CD, a CD-R, a MO, a DVD, and various types of card, in addition to plain paper and has high print quality, and qualities of low noise generation, low cost, easiness in maintenance, and the like. For this reason, the intermediate transfer type thermal transfer line printer has been widely used as an output device of a computer, a word processor, or the like in the past (for example, see Japanese Unexamined Patent Application Publication No. 2002-337373).

In a primary image forming unit, the above-mentioned thermal transfer line printer in the related art makes a line thermal head be in a head-down state where the line thermal head comes into contact with a platen roller with an ink film and an intermediate transfer medium interposed therebetween in this order and makes heat generating elements of the line thermal head selectively generate heat in this state on the basis of printing information (image forming information) while conveying the ink film and the intermediate transfer medium. As a result, ink carried on the ink film is partially melted or sublimated. Then, the thermal transfer line printer forms an inverted image as a primary image, which corresponds to one screen (one page), on the intermediate transfer medium by transferring the ink to the intermediate transfer medium. After that, the thermal transfer line printer conveys the primary image, which is formed on the intermediate transfer medium, to a portion right ahead of a re-transfer unit by conveying the intermediate transfer medium. Subsequently, after the thermal transfer line printer aligns the position of the primary image with the position of the medium to be transferred, the primary image formed on the intermediate transfer medium is melted or sublimated in the re-transfer unit by heat and pressure of re-transfer means, which is formed of a heating roller and the like. Then, the thermal transfer line printer forms (prints) a desired image on the medium to be transferred by transferring (re-transferring) and fixing the primary image to the medium to be transferred.

In this case, when a one-colored image is to be formed on the medium to be transferred, the image can be formed by one pass.

In contrast, when a multi-colored image is to be formed on the medium to be transferred, a multi-color ink film, on which ink areas corresponding to a plurality of colors are repeatedly disposed so that different colors are adjacent to each other in a longitudinal direction, is used as an ink film. After an inverted image formed by an initial color ink carried on the multi-color ink film is formed on the intermediate transfer medium, the line thermal head is in a head-up state where the line thermal head is separated from the platen roller. In this state, the intermediate transfer medium is conveyed in the reverse direction (rewound). Then, after the heading for returning the inverted image formed by the initial color ink to a transfer position is performed, a multicolored primary image is formed by a so-called swing back method of transferring an inverted image corresponding to the next color so that the inverted image corresponding to the next color is superimposed on the inverted image corresponding to the initial color.

Specifically, when a full color image is to be formed, a full color image is formed by using a multi-color ink film on which four color ink areas formed by four color inks, for example, K (black), Y (yellow), M (magenta), and C (cyan) inks are repeatedly disposed in this order so that different colors are adjacent to each other in a longitudinal direction.

That is, at first, a K-colored inverted image corresponding to one screen is formed on the intermediate transfer medium by using a K-colored (black) ink area of the multi-color ink film. Then, the heading of the K-colored inverted image, which is formed on the intermediate transfer medium, is performed by conveying the intermediate transfer medium, which has been conveyed by a primary image forming operation, in the reverse direction. Further, a Y-colored inverted image corresponding to one screen is formed so as to be superimposed on the K-colored inverted image, which corresponds to one screen and is formed on the intermediate transfer medium, by performing the heading of a Y-colored (yellow) ink area adjacent to the K-colored ink area of the multi-color ink film and using the Y-colored ink area of the multi-color ink film. Similarly hereinafter, a full color primary image corresponding to one screen is formed on the intermediate transfer medium by superimposing inverted images on the intermediate transfer medium in the order of an M-colored (magenta) ink area and a C-colored (cyan) ink area.

Here, the intermediate transfer medium is formed in the shape of a belt, and is wound between a pair of reels that is formed of a winding reel and a feeding reel. Further, the intermediate transfer medium can be conveyed in a normal feed direction (front feed) where the intermediate transfer medium is wound on a winding reel by an intermediate transfer medium conveying device and in a reverse feed direction (back feed) where the intermediate transfer medium is wound on a feeding reel.

The intermediate transfer medium conveying device includes a pair of drive shafts. The pair of drive shafts is formed of a winding shaft that rotationally drives the winding reel during normal feed where the intermediate transfer medium is conveyed in the normal feed direction, and a feeding shaft that rotationally drives the feeding reel during reverse feed where the intermediate transfer medium is conveyed in the reverse feed direction. Further, the drive shafts are directly driven by the drive force of the DC motor, so that the winding force for winding the intermediate transfer medium is controlled at an appropriate value. Furthermore, back tension is applied to each of the drive shafts by a torque limiter, which is disposed between the drive shaft and the reel, during the normal feed where the intermediate transfer medium is conveyed in the normal feed direction and during the reverse feed where the intermediate transfer medium is conveyed in the reverse feed direction. For example, a torque limiter, which includes an inner cylinder as an inner ring, an outer cylinder as an outer ring, and a spring (coil spring) interposed between the inner and outer cylinders, is used as the torque limiter from the past (for example, see Japanese Unexamined Patent Application Publication No. 2002-147499).

Intermediate transfer medium conveying devices, which apply back tension by the torque limiter in the related art, have had a problem in that the intermediate transfer medium cannot be appropriately conveyed. That is, when the conveying direction of a transfer medium is inverted, a winding operation is performed in a state where back tension is not applied to the feeding side by the "play (backlash)" of the torque limiter. Accordingly, slack is generated on the intermediate transfer medium.

The "play" of the torque limiter may be play (backlash) between tooth surfaces when a pair of gears mesh with each other.

Further, the "play" of the torque limiter is in the range of 10 to 20° in the circumferential direction about the center of the torque limiter, and is generated when the conveying direction of the intermediate transfer medium is inverted to the reverse feed direction from the normal feed direction and when the conveying direction of the intermediate transfer medium is inverted to the normal feed direction from the reverse feed direction.

Moreover, a slack removing mechanism for removing the slack of an intermediate transfer medium, which is caused by the "play" of the torque limiter, is disposed in the intermediate transfer medium conveying device in the related art in order to appropriately convey the intermediate transfer medium. The slack removing mechanism is formed of tension applying shafts, such as tension bars or tension rollers, which are disposed on the conveying path of the intermediate transfer medium, specifically, on at least one of both sides of a primary image forming unit, preferably, on both sides of the primary image forming unit (for example, see Japanese Unexamined Patent Application Publication No. 2002-337410).

Further, as the intermediate transfer medium conveying device, there is proposed an intermediate transfer medium conveying device including torque limiters (spring type torque limiters) that transmit the drive force of a DC motor to both the drive shafts through a worm gear (crossed helical gear) and are disposed between a driving gear train connected to the worm gear and the drive shafts, respectively, in order to prevent the slack of the intermediate transfer medium that is caused by the "play" of a torque limiter (for example, see Japanese Unexamined Patent Application Publication No. 2007-112007).

However, the thermal transfer line printer using the intermediate transfer medium conveying device in the related art requires a slack removing mechanism for removing the slack of the intermediate transfer medium. For this reason, the structure of the printer is complicated. Accordingly, there has been a problem in that costs are large.

Furthermore, in the thermal transfer line printer using the intermediate transfer medium conveying device in the related art, the parallelism of the tension applying shafts of the slack removing mechanism, that is, the deviation between the width direction orthogonal to the conveying direction of the intermediate transfer medium and the axial direction of the shaft affects the deviation of the conveying position of the intermediate transfer medium. For this reason, an adjusting mechanism for adjusting parallelism is required. Accordingly, the structure of the printer is complicated. Therefore, there has been a problem in that costs are large.

Further, in the thermal transfer line printer using the intermediate transfer medium conveying device including a worm gear in the related art, the slack of the intermediate transfer medium, which is caused by the "play" of the torque limiter connected to the winding shaft, is hardly generated when the conveying direction of the intermediate transfer medium is inverted. However, since the winding force for winding the intermediate transfer medium is determined by the set value of the torque of the torque limiter, there has been a problem in that it may not be possible to change a winding force of the winding shaft for winding the intermediate transfer medium during the normal feed even though a voltage applied to the DC motor (the rotational speed of the DC motor) is changed. That is, since it may not be possible to change a winding force of the winding shaft for winding the intermediate transfer medium during the normal feed, there has been a problem in that it may also not be possible to appropriately convey the intermediate transfer medium.

As a result, in the thermal transfer line printer using the intermediate transfer medium conveying device including the worm gear in the related art, there has been a problem in that it may not be possible to optimize each of the winding force for winding the intermediate transfer medium during the transfer where a primary image is formed on the intermediate transfer medium and the winding force for winding the intermediate transfer medium during the re-transfer where the primary image is re-transferred to a medium to be transferred.

Meanwhile, an optimum winding force for winding the intermediate transfer medium, which is required to separate ink from the ink film and transfer the ink to the intermediate transfer medium during the transfer, is smaller than an optimum winding force for winding the intermediate transfer medium, which is required to separate the primary image from the intermediate transfer medium and transfer the primary image to the medium to be transferred during the re-transfer.

Further, there is demand for an intermediate transfer medium conveying device that can appropriately convey an intermediate transfer medium, and a thermal transfer line printer using the intermediate transfer medium conveying device.

These and other drawbacks exist.

SUMMARY OF THE DISCLOSURE

An advantage of various embodiments is to provide an intermediate transfer medium conveying device that can appropriately convey an intermediate transfer medium, and a thermal transfer line printer using the intermediate transfer medium conveying device.

According to an embodiment, there is provided an intermediate transfer medium conveying device for conveying a belt-like intermediate transfer medium, which is wound between a winding reel and a feeding reel, by a drive force of one DC motor in a normal feed direction where the intermediate transfer medium is wound on the winding reel and in a reverse feed direction where the intermediate transfer medium is wound on the feeding reel. The intermediate transfer medium conveying device includes a winding shaft that rotationally drives the winding reel during normal feed where the intermediate transfer medium is conveyed in the normal feed direction, a feeding shaft that rotationally drives the feeding reel during reverse feed where the intermediate transfer medium is conveyed in the reverse feed direction, transmission means for normal feed that transmits a drive force of the DC motor to the winding shaft during the normal feed, and transmission means for reverse feed that transmits a drive force of the DC motor to the feeding shaft during the reverse feed. The transmission means for normal feed includes first transmission means and second transmission means. The first transmission means is formed so as to directly transmit a drive force of the DC motor to the winding shaft during the normal feed. The second transmission means is formed so as to transmit a drive force of the DC motor to the winding shaft during the normal feed through a torque limiter for reverse feed that applies back tension to the intermediate transfer medium during the reverse feed. The conveyance of the intermediate transfer medium in the normal feed direction and the conveyance of the intermediate transfer medium in the reverse feed direction are inverted to each other by the rotation direction of the DC motor. A winding force, which is generated by the winding shaft when the intermediate transfer medium is wound on the winding reel, is changed by a voltage applied to the DC motor.

The first transmission means may be provided with first connection/disconnection means that connects and disconnects the transmission of a drive force of the DC motor so as to transmit a drive force of the DC motor to the winding shaft during the normal feed and block a drive force of the DC motor during the reverse feed. The second transmission means may be provided with second connection/disconnection means that connects and disconnects the transmission of a drive force of the DC motor so as to transmit a drive force of the DC motor to the winding shaft during the normal feed and block a drive force of the DC motor during the reverse feed prior to the torque limiter for reverse feed. The transmission means for normal feed may be formed so that a drive force is transmitted by the second connection/disconnection means before a drive force is transmitted by the first connection/disconnection means when the conveying direction of the intermediate transfer medium is inverted to the normal feed direction from the reverse feed direction.

The transmission means for reverse feed may include a worm gear for reverse feed, connection/disconnection means for reverse feed, and third transmission means. A drive force of the DC motor is input to the worm gear for reverse feed during the reverse feed. The connection/disconnection means for reverse feed connects and disconnects a drive force of the DC motor so that a drive force of the DC motor is transmitted to the worm gear for reverse feed during the reverse feed and a drive force of the DC motor is not transmitted to the worm gear for reverse feed during the normal feed. The third transmission means transmits the output of the worm gear for reverse feed during the reverse feed to the feeding shaft through a torque limiter for normal feed for applying back tension to the intermediate transfer medium during the normal feed.

Further, according to various embodiments, there is provided an intermediate transfer type thermal transfer line printer including an intermediate transfer medium conveying device. The intermediate transfer medium conveying device conveys a belt-like intermediate transfer medium, which is wound between a winding reel and a feeding reel, by a drive force of one DC motor in a normal feed direction where the intermediate transfer medium is wound on the winding reel and in a reverse feed direction where the intermediate transfer medium is wound on the feeding reel; forms a multicolored primary image by transferring ink of a multi-color ink sheet to the intermediate transfer medium, which is conveyed in the normal feed direction by the intermediate transfer medium conveying device, by a line thermal head; and forms a full color image on a medium to be transferred by re-transferring the primary image, which is formed on the intermediate transfer medium conveyed in the normal feed direction by the intermediate transfer medium conveying device, to a medium to be transferred by re-transfer means. The thermal transfer line printer includes control means. The control means controls voltages applied to the DC motor during transfer and re-transfer in order to individually control a winding force for winding the intermediate transfer medium during the transfer where ink is transferred to the intermediate transfer medium, and a winding force for winding the intermediate transfer medium during the re-transfer where the primary image is re-transferred to the medium to be transferred. The intermediate transfer medium conveying device is the intermediate transfer medium conveying device according to the aspect of the invention.

A voltage applied to the DC motor during the re-transfer may be set to be higher than a voltage applied to the DC motor during the transfer.

According to the intermediate transfer medium conveying device of the aspect of the invention and a thermal transfer line printer using an intermediate transfer medium conveying device, it may be possible to obtain an advantageous effect of appropriately conveying an intermediate transfer medium.

DETAILED DESCRIPTION OF THE DISCLOSURE

Figure 1:
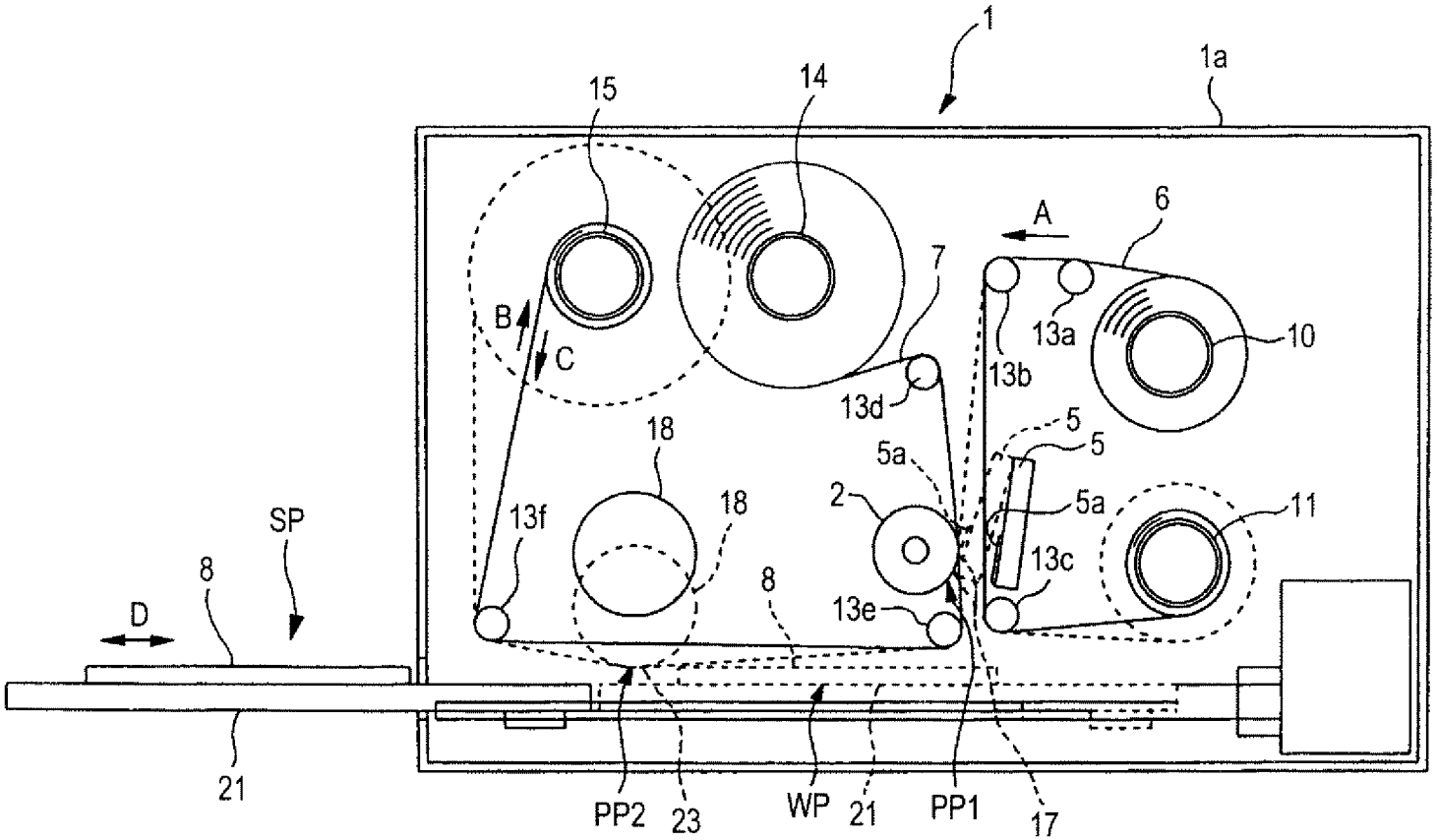
FIG. 1 is a front view of main parts of a thermal transfer line printer that includes an intermediate transfer medium conveying device according to an embodiment of the disclosure.

The invention will be described below with reference to the embodiments shown in the drawings.

The following description is intended to convey a thorough understanding of the embodiments described by providing a number of specific embodiments and details involving intermediate transfer medium conveying device and thermal line printer. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

For the convenience of the description, a thermal transfer line printer including an intermediate transfer medium conveying device according to this embodiment will be described first below with reference to FIGS. 1 to 3.

Figure 2:
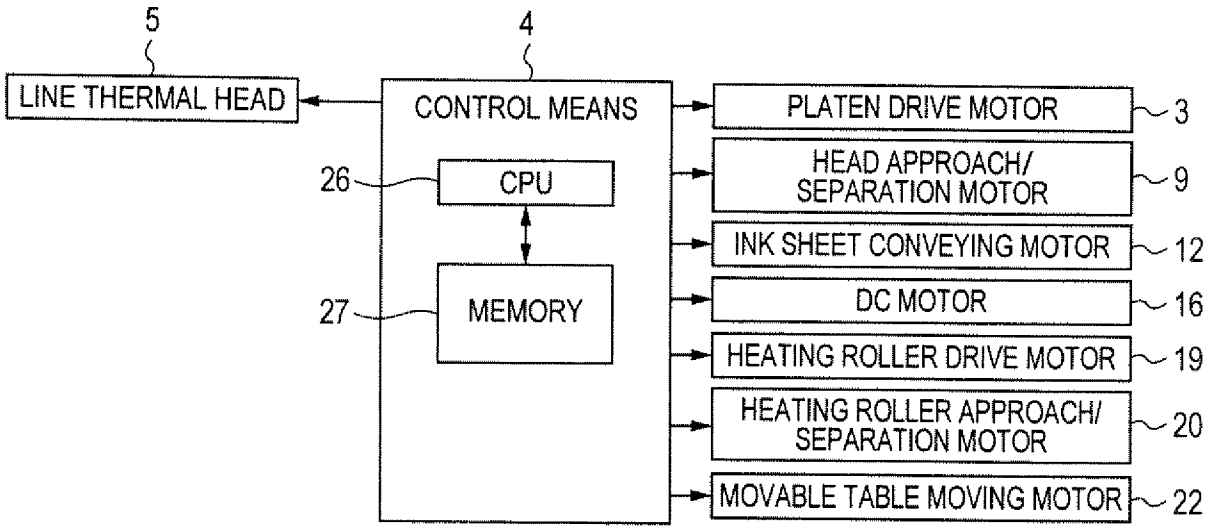
FIG. 2 is a block diagram showing main parts of control means of the thermal transfer line printer shown in FIG. 1.
Figure 3:
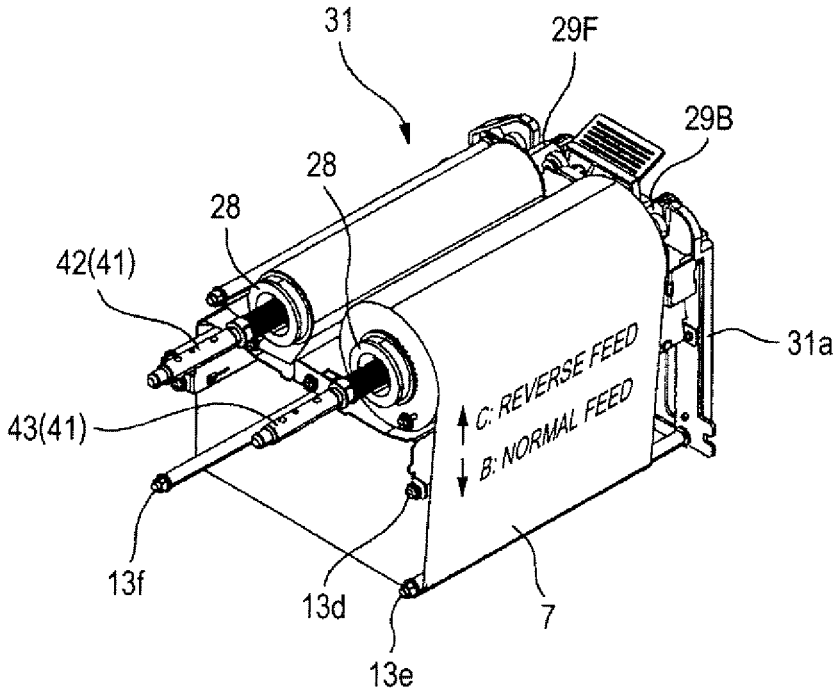
FIG. 3 is a perspective view showing main parts of a transfer sheet cassette, of which a part is omitted, of the thermal transfer line printer shown in FIG. 1.

FIGS. 1 to 3 are views showing a thermal transfer line printer that may include an intermediate transfer medium conveying device according to an embodiment of the disclosure. FIG. 1 is a front view showing main parts, FIG. 2 is a block diagram showing main parts of control means, and FIG. 3 is a perspective view showing main parts of a transfer sheet cassette of which a part is omitted.

As a thermal transfer line printer according to this embodiment, there is exemplified the following thermal transfer line printer. This thermal transfer line printer may repeatedly dispose four color ink areas formed by four color inks, that is, K, Y, M, and C inks, in this order so that different colors are adjacent to each other in a longitudinal direction. Further, this thermal transfer line printer forms full color images as multi-color images by using a multi-color ink sheet on which color discrimination marks are formed at boundary portions between the ink areas.

As shown in FIG. 1, a platen roller 2 may be rotatably disposed in a printer main body 1*a* of a thermal transfer line printer 1. The platen roller 2 can be rotationally driven by the transmission of the drive force of a platen drive motor 3 (FIG. 2) such as a stepping motor. The platen drive motor 3 may be electrically connected to control means 4 (FIG. 2) that may control the operation of each component to be described below. The stoppage, the start-up, the rotational speed, the rotation direction, and the like of the platen drive motor 3 may be controlled on the basis of a control command sent from the control means 4.

A line thermal head 5, which freely approaches and is separated from the platen roller 2, may be disposed on the right side, which is shown on the right in FIG. 1, of the platen roller 2 so that a printing surface 5*a* of the line thermal head faces the outer peripheral surface of the platen roller 2. The line thermal head 5 may extend in a direction parallel to the axial direction of the platen roller 2. In addition, a plurality of heat generating elements (not shown) may be aligned and disposed on the printing surface 5*a* of the line thermal head 5 over the length corresponding to the dimension of a multi-color ink sheet and an intermediate transfer sheet in a direction orthogonal to the conveying direction of the multi-color ink sheet 6 shown by an arrow A in FIG. 1 and the conveying direction of the intermediate transfer sheet 7 as a belt-like intermediate transfer medium shown by arrows B and C in FIG. 1. The length of the array of the heat generating elements may be longer than the size of an image, which may be formed on a medium 8 to be transferred, in the direction orthogonal to the conveying direction. Further, the line thermal head 5 may be electrically connected to the control means 4, and the respective heat generating elements may selectively generate heat by a control command sent from the control means 4 on the basis of printing information.

The line thermal head 5 may be formed so as to selectively take at least two positions of a head-up position and a head-down position by a head approach/separation mechanism (not shown) that is operated by the drive force of a head approach/separation motor 9 (FIG. 2). The head-up position may correspond to a head-up state in which the line thermal head is separated from the platen roller 2 shown by a solid line in FIG. 1. The head-down position may correspond to a head-down state in which the line thermal head comes into press contact with the platen roller 2 shown by a broken line in FIG. 1. Further, the head approach/separation motor 9 may be electrically connected to the control means 4, and may control the position of the line thermal head 5 at a predetermined timing on the basis of a control command sent from the control means 4.

The multi-color ink sheet 6 and the intermediate transfer sheet 7 may be supplied between the platen roller 2 and the line thermal head 5 in this order from the line thermal head 5.

The multi-color ink sheet 6 may be wound between an ink sheet feeding reel 10 that is disposed near the right side in FIG. 1 in the printer main body 1*a* and an ink sheet winding reel 11 that is disposed below the ink sheet feeding reel. Further, at least the ink sheet winding reel 11 is rotationally driven by the drive force of an ink sheet conveying motor 12 (FIG. 2) formed of a control motor such as a stepping motor, so that the multi-color ink sheet 6 is unwound from the ink sheet feeding reel 10 and wound on the ink sheet winding reel 11. Furthermore, the conveying path and the conveying direction of the multi-color ink sheet may be controlled so that the multi-color ink sheet 6 unwound from the ink sheet feeding reel 10 passes by at least three guide rollers 13*a*, 13*b*, and 13*c* rotatably disposed in the printer main body 1*a* and is wound on the ink sheet winding reel 11 as shown by the arrow A in FIG. 1. In addition, the conveying path of the multi-color ink sheet 6 may be formed so that the back surface of the multi-color ink sheet on which the ink areas (not shown) are not formed faces the line thermal head 5. Further, the ink sheet conveying motor 12 may be electrically connected to the control means 4. The stoppage, the start-up, the rotational speed, and the like of the ink sheet conveying motor 12 may be controlled on the basis of a control command sent from the control means 4.

The intermediate transfer sheet 7 may be wound between a cylindrical feeding reel 14 that may be disposed above the platen roller 2 and slightly on the left side of the platen roller 2 in the printer main body 1*a* and a cylindrical winding reel 15 that is disposed near an upper left corner in the printer main body 1*a* shown in FIG. 1. Furthermore, the winding reel 15 may be rotationally driven by the drive force of one DC motor 16 (FIG. 2) as an intermediate transfer sheet conveying motor, so that the intermediate transfer sheet 7 is unwound from the feeding reel 14 and wound on the winding reel 15. Moreover, the DC motor 16 may be electrically connected to the control means 4. The stop, the start-up, the rotation direction, the rotational speed, and the like of the DC motor 16 may be controlled on the basis of a control command sent from the control means 4.

Further, the conveying path and the conveying direction of the intermediate transfer sheet may be controlled so that the intermediate transfer sheet 7 unwound from the feeding reel 14 may pass by at least a guide roller 13*d*, which may be rotatably disposed in the printer main body 1*a*, the outer periphery of the platen roller 2, and two guide rollers 13*e* and 13*f* rotatably disposed in the printer main body 1*a* in this order, and may be wound on the winding reel 15 as shown by the arrow B in FIG. 1.

Furthermore, the conveying path of the intermediate transfer sheet 7 may be formed so that the intermediate transfer sheet 7 may overlap the multi-color ink sheet 6 at a contact position where the intermediate transfer sheet comes into contact with the platen roller 2. Accordingly, the intermediate transfer sheet 7 can face the ink areas of the multi-color ink sheet 6 at this position. Moreover, the intermediate transfer sheet 7 can be conveyed in a normal feed direction where the intermediate transfer sheet 7 is wound on the winding reel 15 as shown by the arrow B in FIG. 1 and a reverse feed direction where the intermediate transfer sheet 7 is wound on the feeding reel 14 as shown by the arrow C in FIG. 1, by an intermediate transfer medium conveying device 41 to be described below.

In addition, the feeding reel 14 and the winding reel 15 on which the intermediate transfer sheet 7 is wound may be detachably mounted on a transfer sheet cassette 31 to be described below.

The platen roller 2 and the line thermal head 5 may form a primary image forming unit 17 that forms a primary image formed of an inverted image (not shown) on the intermediate transfer sheet 7 by transferring the ink of the multi-color ink sheet 6 of this embodiment to the intermediate transfer sheet 7.

A press contact position between the line thermal head 5 and the platen roller 2 in the head-down state, which is shown by a broken line in FIG. 1 and in which the line thermal head 5 may come into press contact with the platen roller 2 with a predetermined contact force, is referred to as an intermediate transfer position PP1 where a primary image formed of an inverted image is formed on the intermediate transfer sheet 7 by the transfer of the ink of the multi-color ink sheet 6 to the intermediate transfer sheet 7.

A heating roller 18 as re-transfer means may be disposed on the downstream side of the primary image forming unit 17 in the conveying direction of the intermediate transfer sheet 7, in detail, between the two guide rollers 13*e* and 13*f* that are positioned below the position of the platen roller 2 in FIG. 1, so as to face the conveying path of the intermediate transfer sheet 7 from above. Further, the heating roller 18 can be rotationally driven by the transmission of the drive force of a heating roller drive motor 19 (FIG. 2) such as a stepping motor. Furthermore, the heating roller 18 may be formed so as to selectively take at least two positions of a separation position and a press contact position by a heating roller approach/separation mechanism (not shown) that is operated by the drive force of a heating roller approach/separation motor 20 (FIG. 2). The separation position may correspond to a separation state in which the heating roller is separated from the intermediate transfer sheet 7 shown by a solid line in FIG. 1. The press contact position may correspond to a press contact state in which the heating roller may come into press contact with the intermediate transfer sheet 7 shown by a broken line in FIG. 1. Moreover, the heating roller drive motor 19 and the heating roller approach/separation motor 20 may be electrically connected to the control means 4, and control the rotation of the heating roller 18 and the position of the heating roller 18 at a predetermined timing on the basis of a control command sent from the control means 4.

A medium 8 to be transferred, that is, a DVD in this embodiment, for example, may be supplied below the heating roller 18 with the intermediate transfer sheet 7 interposed therebetween. The medium 8 to be transferred may be placed on the upper surface of a movable table 21 that is formed in the shape of a flat plate. The movable table 21 can reciprocate in a horizontal direction, which is shown by both arrows D in FIG. 1, by the drive force of a movable table moving motor 22 (FIG. 2). Further, since the movable table 21 reciprocates by the drive force of the movable table moving motor 22, the medium 8 to be transferred can reciprocate between at least two positions of a supply/pickup position SP that is shown by a solid line in FIG. 1 and a re-transfer waiting position WP that is shown by a broken line in FIG. 1. Moreover, the movable table moving motor 22 may be electrically connected to the control means 4. The stop, the start-up, the rotational speed, the rotation direction, and the like of the movable table moving motor 22 may be controlled on the basis of a control command sent from the control means 4, for example. Meanwhile, when the medium 8 to be transferred is positioned at the supply/pickup position SP shown by a solid line in FIG. 1, the medium 8 to be transferred may be exposed to the outside of the printer main body 1*a*, so that the medium 8 to be transferred can be easily supplied to the movable table 21 and picked up from the movable table 21.

The medium 8 to be transferred is not limited to a DVD. Various objects, such as a CD-R, MO, a stock certificate, securities, a bond, bankbooks, a pass, a ticket for a performance, an admission ticket, a ticket, a cash card, a credit card, a prepaid card, a postcard, a business card, an IC card, an optical disc, a calendar, a poster, a pamphlet, accessories, stationery, and a writing material, may be exemplified as the medium to be transferred. Further, a material not deformed by heat during re-transfer may be used as the material of the medium 8 to be transferred. Various materials, such as paper, a resin, glass, metal, ceramics, and cloth, may be exemplified as the material of the medium to be transferred.

The heating roller 18 may form a re-transfer unit 23 that forms an image on the medium 8 to be transferred by re-transferring the primary image, which is formed on the intermediate transfer sheet 7 of this embodiment, to the medium 8 to be transferred.

Furthermore, a press contact position, where the heating roller 18 shown by a broken line in FIG. 1 may come into press contact with the medium 8 to be transferred with a predetermined contact force, is referred to as a re-transfer position PP2 where an image is formed on the medium 8 to be transferred by the re-transfer of the primary image, which is formed on the intermediate transfer sheet 7, to the medium 8 to be transferred.

As shown in FIG. 2, the thermal transfer line printer 1 according to this embodiment may include the control means 4 that may control the operations of the respective components. The control means 4 may include at least a CPU 26 and a memory 27. The CPU 26 may perform various kinds of arithmetic processing. The memory 27 may be formed of a ROM, a RAM, flash memory, or the like that has an appropriate capacity and stores various programs for various kinds of processing, such as control and judgment. At least the platen drive motor 3; the line thermal head 5; the head approach/separation motor 9; the ink sheet conveying motor 12; the DC motor 16; the heating roller drive motor 19; the heating roller approach/separation motor 20; the movable table moving motor 22; warning means that is formed of an indication light, a buzzer, or the like (not shown) for making an operator recognize an error; and well-known various switches, sensors, and the like that affect a power switch or a printing operation may be electrically connected to the control means 4 through a system bus, drive circuits, and the like.

Further, the platen drive motor 3, the line thermal head 5, the head approach/separation motor 9, the ink sheet conveying motor 12, the DC motor 16, the heating roller drive motor 19, the heating roller approach/separation motor 20, the movable table moving motor 22, and the like are connected to the control means through dedicated drive circuits (not shown) as controllers for driving themselves, respectively.

The memory 27 of this embodiment may store at least a program for conveying the intermediate transfer sheet 7 in the normal feed direction where the intermediate transfer sheet 7 is wound on the winding reel 15 during the transfer where ink is transferred to the intermediate transfer sheet 7 and the re-transfer where a primary image is re-transferred to the medium 8 to be transferred; and a program for conveying the intermediate transfer sheet 7 in the reverse feed direction where the intermediate transfer sheet 7 may be wound on the feeding reel 14 to overlap different colors during the transfer.

Further, the memory 27 may store various programs such as programs for controlling the operation procedure and the operation of each movable unit or programs for performing an initialization operation when power is supplied; and data required when transfer and re-transfer are performed, such as data of a voltage applied to the DC motor 16 for controlling a winding force for winding the intermediate transfer sheet 7 during transfer and re-transfer and data required to control the rotation direction of the DC motor 16 for conveying the intermediate transfer sheet 7 in the normal feed direction or the reverse feed direction.

As shown in FIG. 3, the transfer sheet cassette 31 of this embodiment may include a cassette frame 31*a* (of which only a part is shown on the upper right side in FIG. 3). The feeding reel 14 and the winding reel 15 (FIG. 2) on which intermediate transfer sheet 7 is wound may be detachably mounted on the cassette frame 31*a*. Accordingly, when the intermediate transfer sheet 7 is replaced, the feeding reel 14 and the winding reel 15 on which the intermediate transfer sheet 7, which is provided for use and has been used, is wound can be detached from the transfer sheet cassette 31 and a feeding reel 14 and a winding reel 15 on which a new intermediate transfer sheet 7 is wound can be mounted on the transfer sheet cassette 31. Of course, the transfer sheet cassette 31 may be detachably mounted in the printer main body 1*a*, and the transfer sheet cassette 31 may be mounted and detached on and from the thermal transfer line printer 1 in a direction orthogonal to the conveying direction of the intermediate transfer sheet 7 when the intermediate transfer sheet 7 is replaced.

The feeding reel 14 may be detachably interposed between a pair of bobbins 28 (of which only a part is shown on the lower left side in FIG. 3) that is detachably inserted into support holes (not shown) formed at both end portions of the feeding reel in the axial direction thereof. Further, one bobbin 28 may be mounted on a feeding shaft 43 of an intermediate transfer medium conveying device 41 (to be described below) that is disposed in the printer main body 1*a*. The other bobbin 28 may be mounted on a reel support member 29F that is rotatably supported by the cassette frame 31*a*. Furthermore, like the feeding reel 14, the winding reel 15 may be detachably interposed between a pair of bobbins 28 (of which only a part is shown on the lower left side in FIG. 3) that is detachably inserted into support holes (not shown) formed at both end portions of the winding reel in the axial direction thereof. Moreover, one bobbin 28 may be mounted on a winding shaft 42 of the intermediate transfer medium conveying device 41 (to be described below) that is disposed in the printer main body 1*a*. The other bobbin 28 may be mounted on a reel support member 29B that is rotatably supported by the frame.

The above-mentioned three guide rollers 13*d*, 13*e*, and 13*f* may be disposed in the cassette frame 31*a* at predetermined positions.

Accordingly, unlike in the thermal transfer line printer in the related art, as shown in FIGS. 1 and 3, a tension applying shaft of a slack removing mechanism for maintaining constant tension of the intermediate transfer sheet 7 is not disposed on the conveying path of the intermediate transfer sheet 7 in the transfer sheet cassette 31 of this embodiment and, eventually, the printer main body 1*a*.

Meanwhile, since other structures of the thermal transfer line printer 1, the transfer sheet cassette 31, and the like are similar to those in the related art, the detailed description thereof will be omitted.

Figure 4:
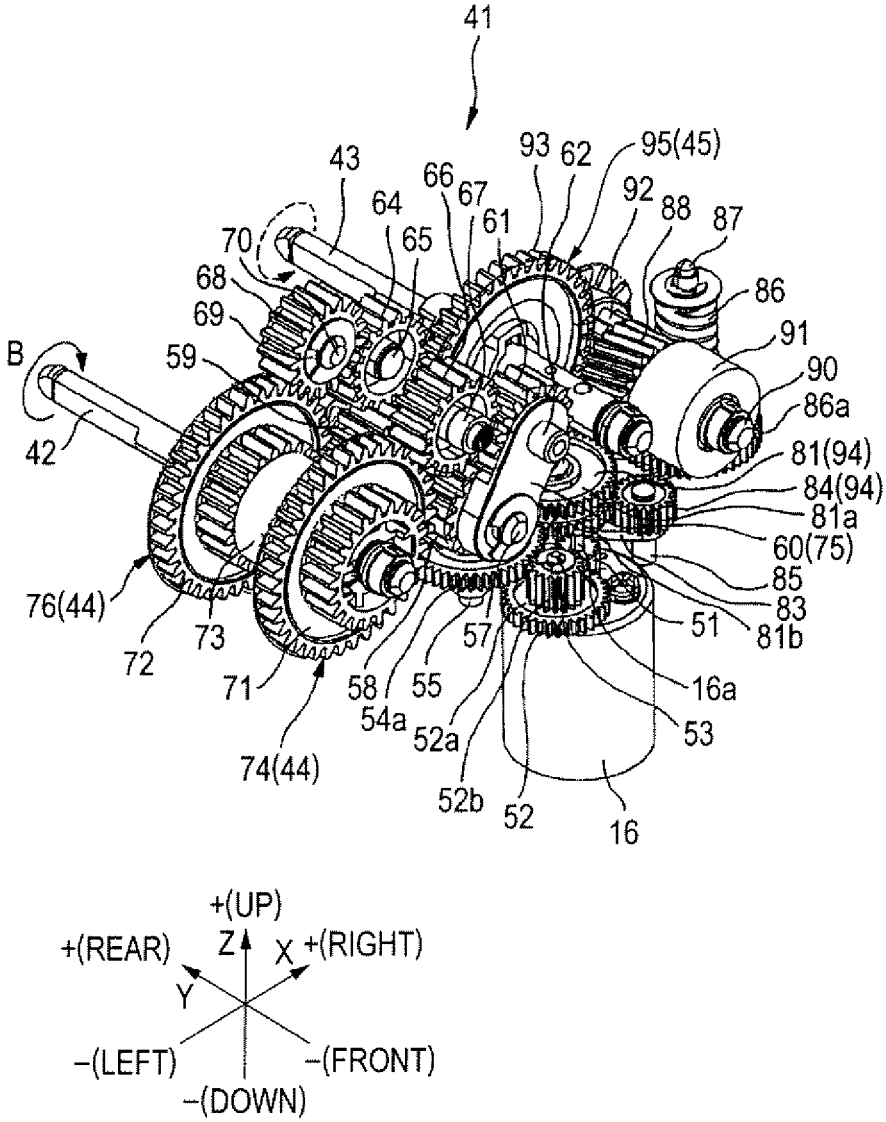
FIG. 4 is a perspective view showing the structure of main parts of the intermediate transfer medium conveying device according to the embodiment of the disclosure during normal feed.
Figure 5:
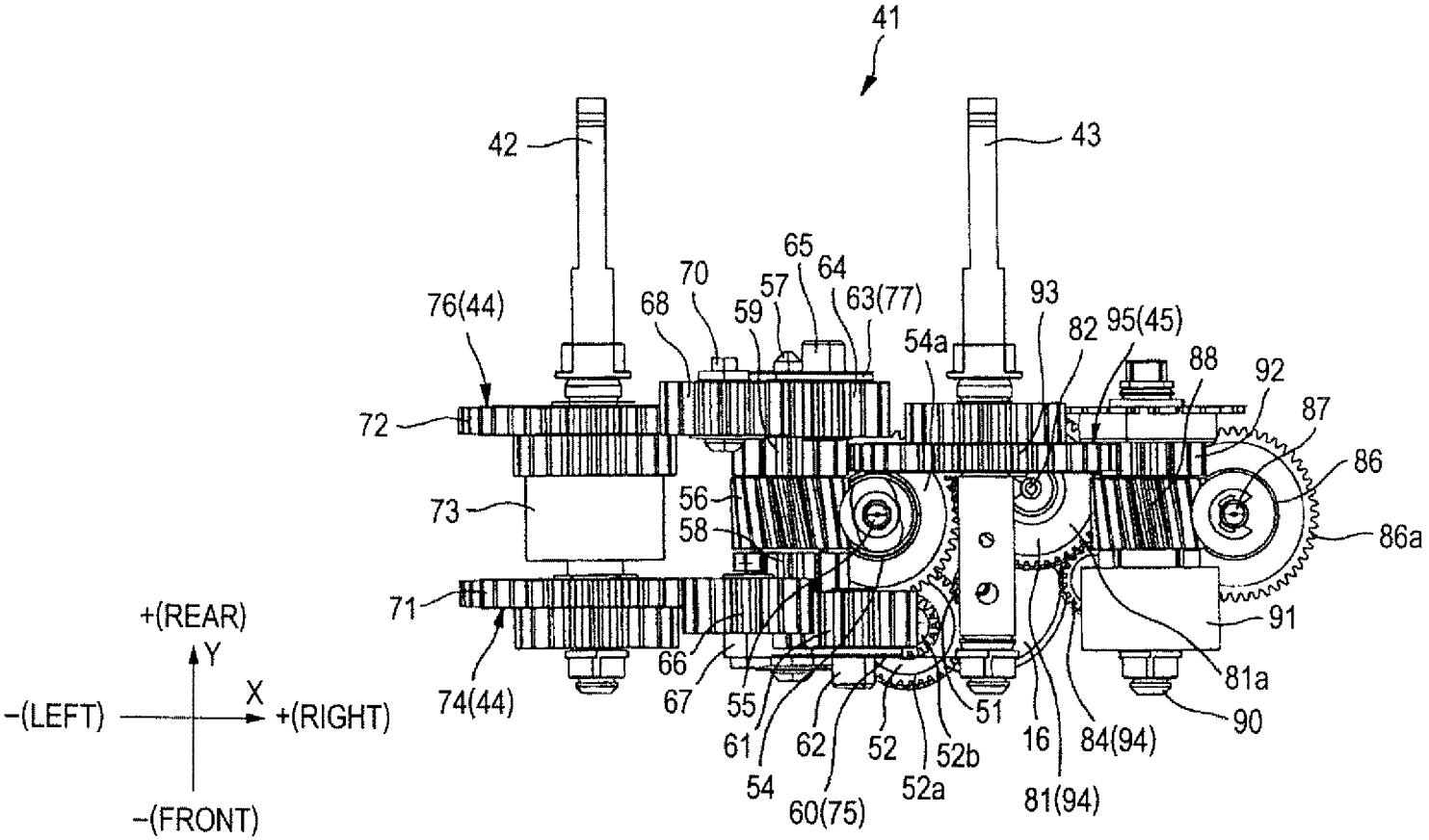
FIG. 5 is a plan view of FIG. 4.
Figure 6:
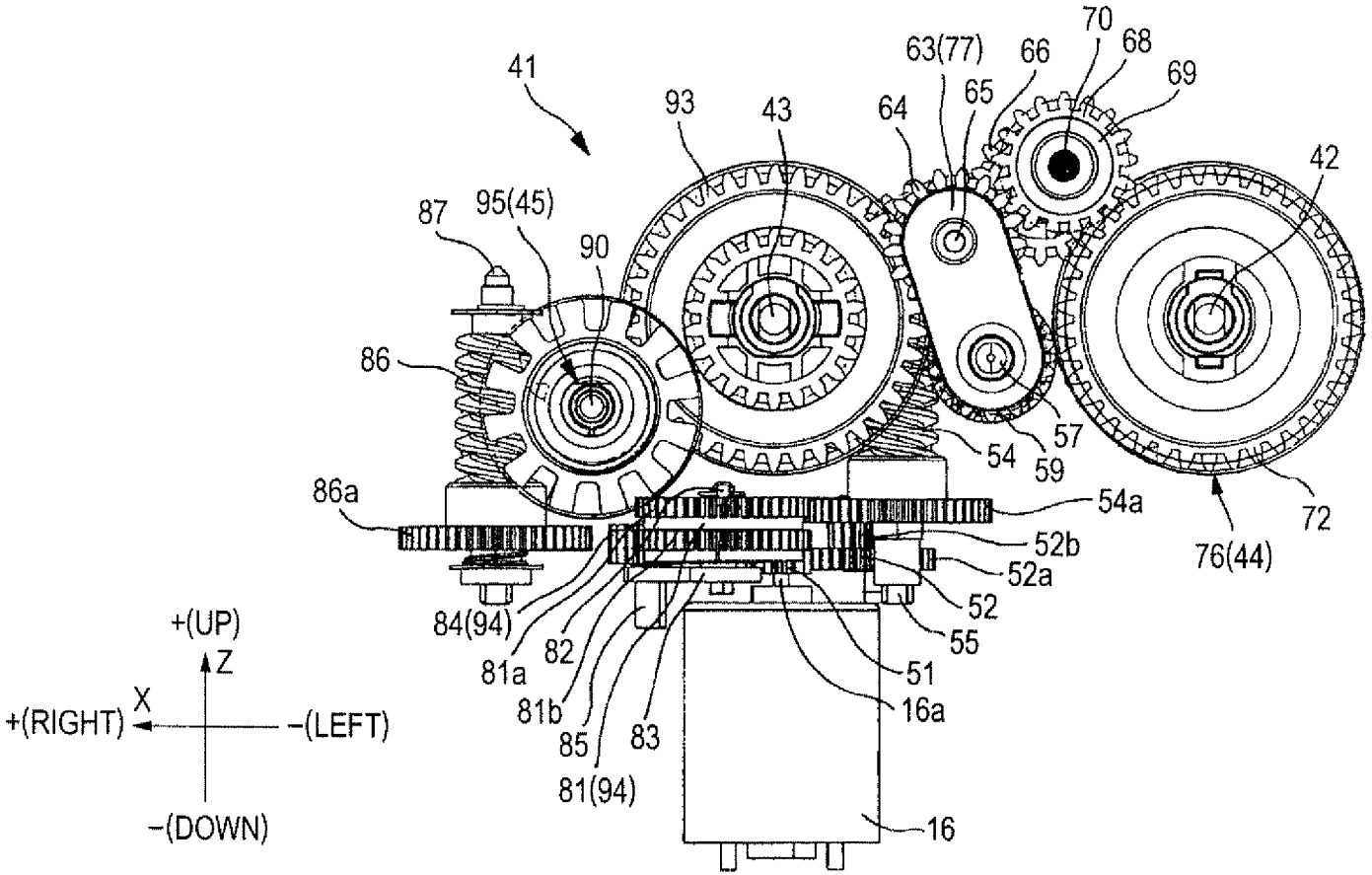
FIG. 6 is a rear side view of FIG. 4.
Figure 7:
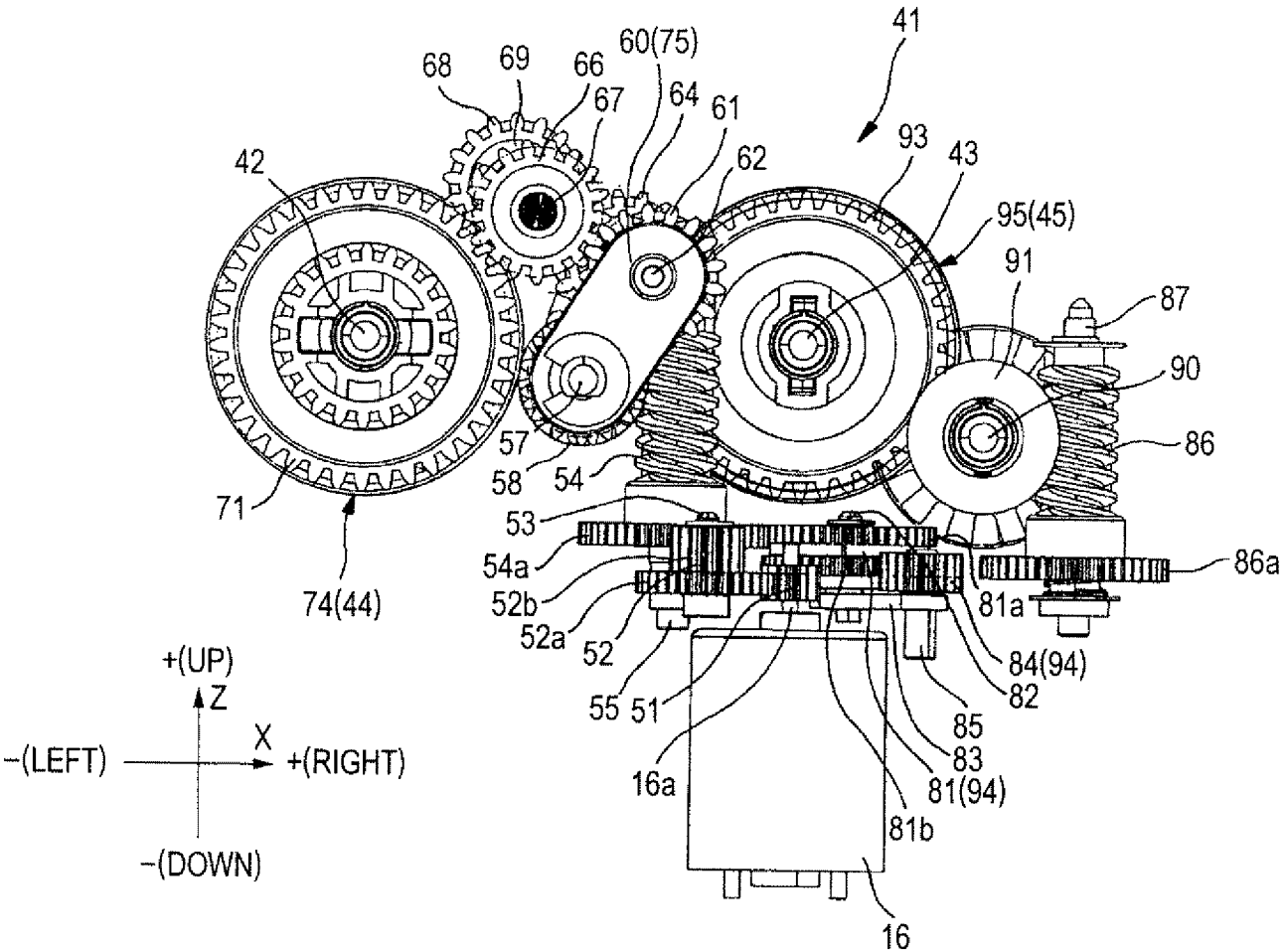
FIG. 7 is a front side view of FIG. 4.
Figure 8:
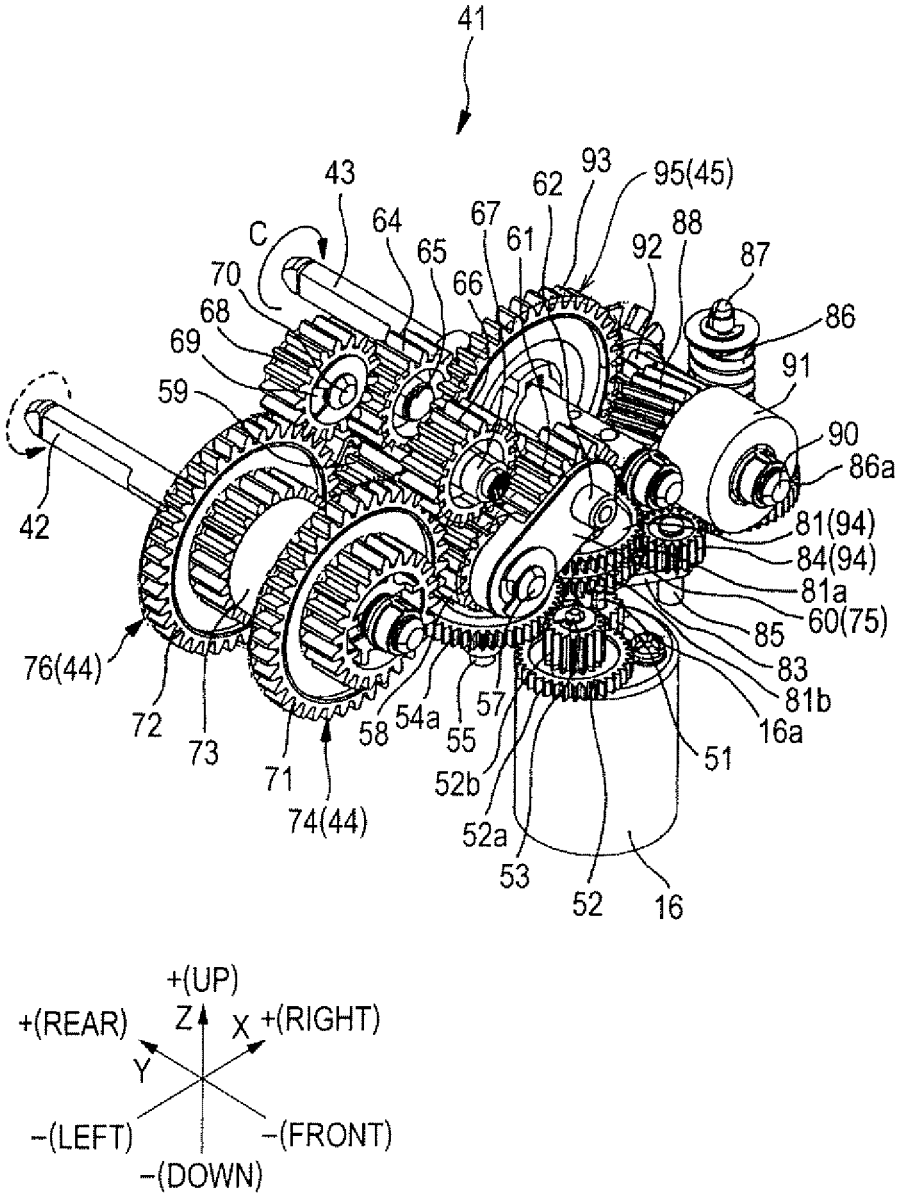
FIG. 8 is a perspective view showing the structure of main parts of the intermediate transfer medium conveying device according to an embodiment of the disclosure during reverse feed.
Figure 9:
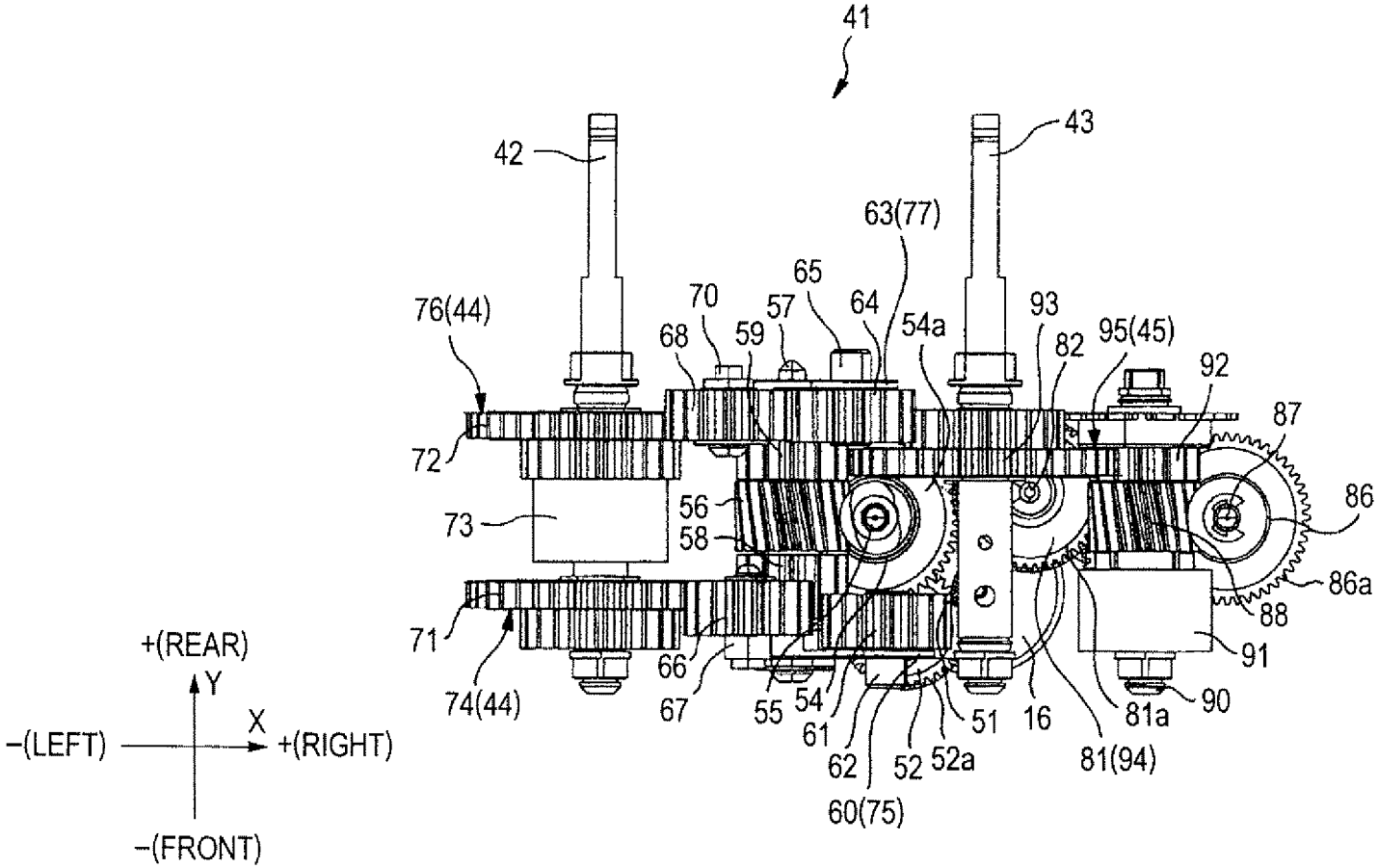
FIG. 9 is a plan view of FIG. 8.
Figure 10:
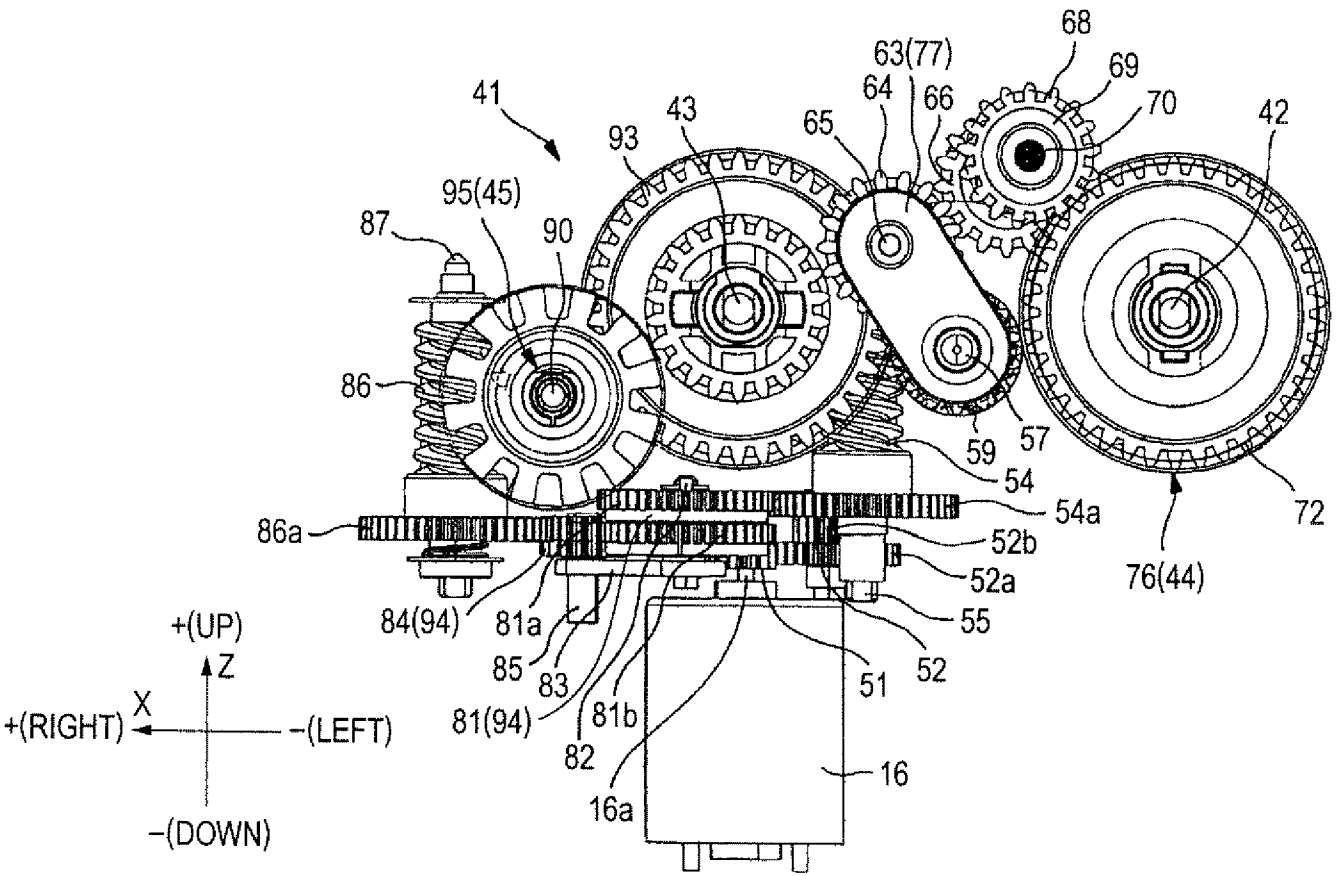
FIG. 10 is a rear side view of FIG. 8.
Figure 11:
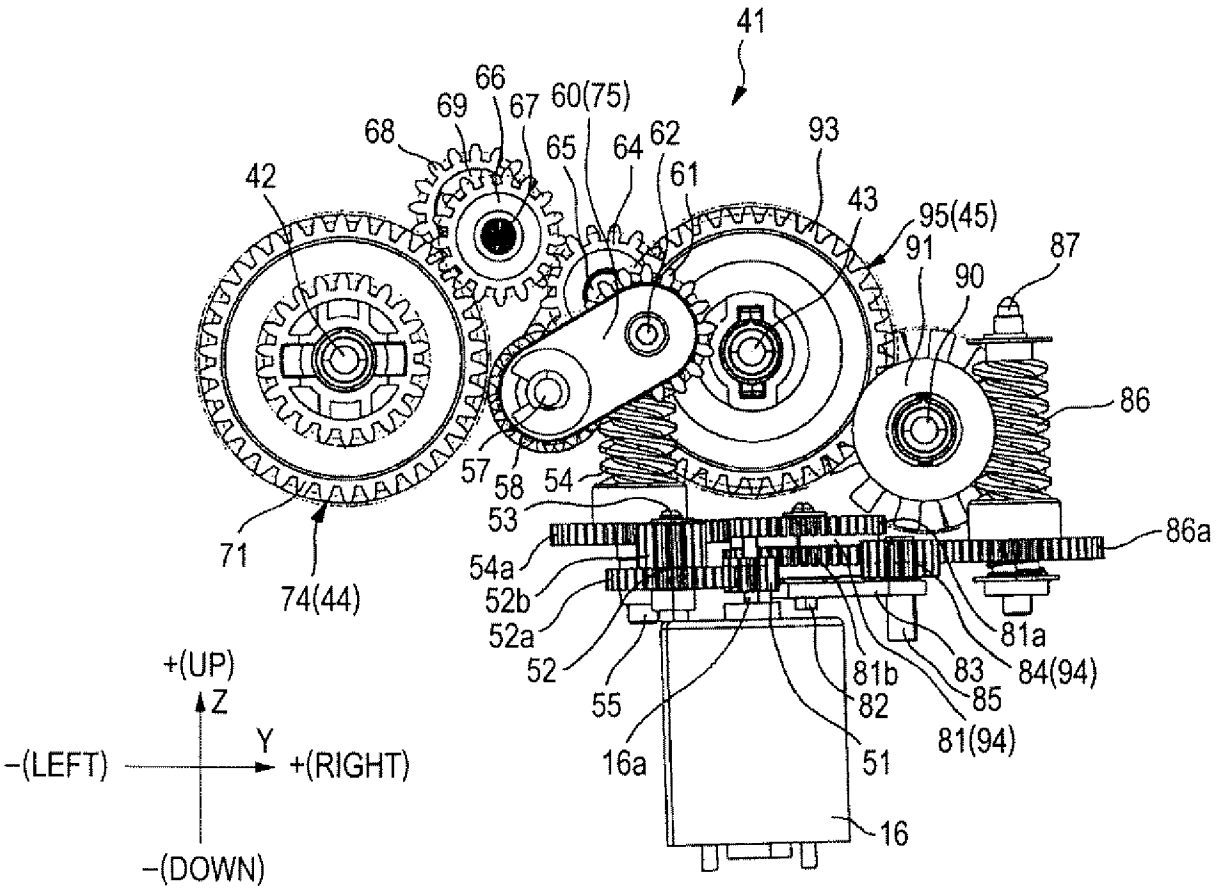
FIG. 11 is a front side view of FIG. 8.

FIGS. 4 to 11 are views showing the intermediate transfer medium conveying device according to an embodiment of the invention, FIG. 4 is a perspective view showing the structure of main parts of the intermediate transfer medium conveying device according to the embodiment during normal feed, FIG. 5 is a plan view of FIG. 4, FIG. 6 is a left side view of FIG. 4, FIG. 7 is a right side view of FIG. 4, FIG. 8 is a perspective view showing the structure of main parts of the intermediate transfer medium conveying device according to the embodiment during reverse feed, FIG. 9 is a plan view of FIG. 8, FIG. 10 is a left side view of FIG. 8, and FIG. 11 is a right side view of FIG. 8.

Here, for the convenience of the description, the arrangement direction of a winding shaft 42 and a feeding shaft 43 to be described below is referred to as an X axis direction; the axial direction of each of the winding shaft 42 and the feeding shaft 43, which is a direction orthogonal to the arrangement direction, is referred to as a Y axis direction; and a direction orthogonal to both the X axis direction and the Y axis direction is referred to as a Z axis direction. Further, the positive side of an X axis will be referred to as the "right side", the negative side of an X axis will be referred to as the "left side", the positive side of a Y axis will be referred to as the "rear side", the negative side of a Y axis will be referred to as the "front side", the positive side of a Z axis will be referred to as the "upper side", and the negative side of a Z axis will be referred to as the "lower side" in the following description.

As shown in FIGS. 4 to 11, the intermediate transfer medium conveying device 41 according to this embodiment may include one DC motor 16, the winding shaft 42, the feeding shaft 43, transmission means 44 for normal feed, and transmission means 45 for reverse feed.

The DC motor 16 may be a drive source of the intermediate transfer medium conveying device 41, that is, a drive source for conveying the intermediate transfer sheet 7 as an intermediate transfer medium. The DC motor 16 may be mounted on a frame (not shown) so that an output shaft 16*a* of the DC motor faces upward.

The winding shaft 42 may be for rotationally driving the winding reel 15 in a direction of the arrow B (FIGS. 1 and 4), which is a clockwise direction when seen from the front side, during the normal feed where the intermediate transfer sheet 7 is conveyed in the normal feed direction where the intermediate transfer sheet 7 is wound on the winding reel 15 (FIG. 1). The winding shaft 42 may be disposed so that the axial direction of the winding shaft is parallel to a forward/rearward direction.

The feeding shaft 43 may be for rotationally driving the feeding reel 14 in a direction of the arrow C (FIGS. 1 and 8), which is a counterclockwise direction when seen from the front side, during the reverse feed where the intermediate transfer sheet 7 is conveyed in the reverse feed direction where the intermediate transfer sheet 7 is wound on the feeding reel 14 (FIG. 1). The feeding shaft 43 may be disposed so that the axial direction of the feeding shaft is parallel to a forward/rearward direction.

The winding shaft 42 and the feeding shaft 43 may be disposed parallel to each other. Further, the winding shaft 42 may be rotated in a direction opposite to the rotation direction of the feeding shaft 43 that is rotationally driven during the reverse feed. The feeding shaft 43 may be rotated in a direction opposite to the rotation direction of the winding shaft 42 that is rotationally driven during the normal feed.

The transmission means 44 for normal feed may be for transmitting torque, which is the drive force of the DC motor 16, to the winding shaft 42 during the normal feed. The transmission means 44 for normal feed may include a pinion 51 that is mounted on the output shaft 16*a* of the DC motor 16. A main transmission gear 52 may be disposed on the left side of the pinion 51, and the main transmission gear 52 may be rotatably supported by a main transmission gear support shaft 53. Further, the main transmission gear support shaft 53 may be disposed so that the axial direction of the main transmission gear support shaft is parallel to the upward/downward direction. The lower end portion of the main transmission gear support shaft 53 may be mounted on a frame (not shown). Furthermore, the main transmission gear 52 may be formed of a two-step gear including a sub gear 52*b*. The sub gear 52*b* may be formed at the upper end of a main gear 52*a* always meshing with the pinion 51 so as to be coaxial with the main gear 52*a*, has a small diameter, and may be rotated integrally with the main gear 52*a*.

A worm gear 54 for normal feed may be disposed on the rear side of the main transmission gear 52. The worm gear 54 for normal feed may be rotatably supported by a worm gear support shaft 55 for normal feed. Further, the worm gear support shaft 55 for normal feed is disposed so that the axial direction of the worm gear support shaft for normal feed is parallel to an upward/downward direction. The lower end portion of the worm gear support shaft 55 for normal feed may be mounted on a frame (not shown). Further, an intermediate gear 54*a* for normal feed, which has a large diameter and always meshes with the sub gear 52*b*, may be formed integrally with the lower end portion of the worm gear 54 for normal feed.

A worm wheel 56 for normal feed, which always meshes with the worm gear 54 for normal feed, may be disposed on the left side of the worm gear 54 for normal feed (FIGS. 5 and 9). The worm wheel 56 for normal feed may be rotatably supported substantially in the middle portion of a worm wheel support shaft 57 for normal feed in the axial direction. Further, the worm wheel support shaft 57 for normal feed may be disposed so that the axial direction of the worm wheel support shaft 57 for normal feed is parallel to the forward/rearward direction. Both ends of the worm wheel support shaft 57 for normal feed may be mounted on a frame (not shown).

A front branch gear 58 that is engaged with the front end face of the worm wheel 56 for normal feed and a rear branch gear 59 that is engaged with the rear end face of the worm wheel 56 for normal feed may be rotatably supported by the worm wheel support shaft 57 for normal feed. When the worm wheel 56 for normal feed is rotated, the respective front and rear branch gears 58 and 59 may be rotated integrally with the worm wheel 56 for normal feed in the same direction.

The base end portion of a front swing arm 60, which may be formed in the shape of a plate, may be rotatably supported by the front end portion of the worm wheel support shaft 57 for normal feed. The rear end face of the tip portion of the front swing arm 60 may contact the front end face of a front swing gear 61 by a pushing force of a spring (not shown), and may be rotated in the same direction as the rotation direction of the front branch gear 58 by a frictional force generated between the rear end face of the tip portion of the front swing arm 60 and the front end face of the front swing gear 61. That is, the tip portion of the front swing arm 60 swings about the worm wheel support shaft 57 for normal feed so that the tip portion of the front swing arm approaches the winding shaft 42 during the normal feed and may be separated from the winding shaft 42 during the reverse feed. Further, the front swing gear 61 may be disposed on the rear side of the tip portion of the front swing arm 60. The front swing gear 61 may be rotatably supported by a front swing gear support shaft 62. Furthermore, the front swing gear support shaft 62 may be disposed so that the axial direction of the front swing gear support shaft is parallel to the forward/rearward direction. The front end portion of the front swing gear support shaft 62 may be mounted near the tip portion of the front swing arm 60. Accordingly, the front swing gear 61 swings about the worm wheel support shaft 57 for normal feed so that the front swing gear approaches the winding shaft 42 during the normal feed and is separated from the winding shaft 42 during the reverse feed. That is, the front swing gear 61 is connected to the front branch gear 58 and a spring is disposed at the front swing gear 61. Accordingly, if the front branch gear 58 is rotated, the front swing gear 61 also may be rotated (in a direction opposite to the rotation direction of the front branch gear 58). Therefore, the front swing arm 60 may be rotated in the same direction as the rotation direction of the front branch gear 58 by a frictional force generated between itself and the front end portion of the front swing gear 61.

The base end portion of a rear swing arm 63, which may be formed in the shape of a plate, may be rotatably supported by the rear end portion of the worm wheel support shaft 57 for normal feed. The front end face of the tip portion of the rear swing arm 63 may contact the rear end face of a rear swing gear 64 by a pushing force of a spring (not shown), and may be rotated in the same direction as the rotation direction of the rear branch gear 59 by a frictional force generated between the front end face of the tip portion of the rear swing arm 63 and the rear end face of the rear swing gear 64. That is, the tip portion of the rear swing arm 63 may swing about the worm wheel support shaft 57 for normal feed so that the tip portion of the rear swing arm approaches the winding shaft 42 during the normal feed and is separated from the winding shaft 42 during the reverse feed. Further, the rear swing gear 64 may be disposed on the front side of the tip portion of the rear swing arm 63. The rear swing gear 64 may be rotatably supported by a rear swing gear support shaft 65. Furthermore, the rear swing gear support shaft 65 may be disposed so that the axial direction of the rear swing gear support shaft is parallel to the forward/rearward direction. The rear end portion of the rear swing gear support shaft 65 may be mounted near the tip portion of the rear swing arm 63. Accordingly, like the front swing gear 61, the rear swing gear 64 may swing about the worm wheel support shaft 57 for normal feed so that the rear swing gear approaches the winding shaft 42 during the normal feed and is separated from the winding shaft 42 during the reverse feed. That is, the rear swing gear 64 may be connected to the rear branch gear 59 and a spring may be disposed at the rear swing gear 64. Accordingly, if the rear branch gear 59 is rotated, the rear swing gear 64 also may be rotated (in a direction opposite to the rotation direction of the rear branch gear 59). Therefore, the front swing arm may be rotated in the same direction as the rotation direction of the rear branch gear 59 by a frictional force generated between itself and the rear end portion of the rear swing gear 64.

A front intermediate gear 66, which meshes with the front swing gear 61 during the normal feed (FIG. 7) and is separated from the front swing gear 61 during the reverse feed (FIG. 11), may be disposed on the upper left side of the front swing gear 61. The front intermediate gear 66 may be rotatably supported by a front intermediate gear support shaft 67. Further, the front intermediate gear support shaft 67 may be disposed so that the axial direction of the front intermediate gear support shaft is parallel to the forward/rearward direction. The front end portion of the front intermediate gear support shaft 67 may be mounted on a frame (not shown).

A rear intermediate gear 68, which meshes with the rear swing gear 64 during the normal feed (FIG. 6) and is separated from the rear swing gear 64 during the reverse feed (FIG. 10), may be disposed on the upper left side of the rear swing gear 64. An outer ring of a one-way clutch 69, which may be formed in a cylindrical shape as a whole, may be mounted at the center of the rear intermediate gear 68. Further, an inner ring of the one-way clutch 69 may be mounted on a rear intermediate gear support shaft 70. Furthermore, the rear intermediate gear support shaft 70 may be disposed so that the axial direction of the rear intermediate gear support shaft is parallel to the forward/rearward direction. The rear end portion of the rear intermediate gear support shaft 70 may be mounted on a frame (not shown). Accordingly, the outer ring of the one-way clutch 69 may idle relative to the inner ring during the normal feed, so that the rear intermediate gear 68 is rotatably supported by the one-way clutch. The outer ring of the one-way clutch 69 may be engaged with the inner ring during the reverse feed, so that the rotation of the rear intermediate gear 68 is inhibited.

Here, the above-mentioned front and rear swing arms 60 and 63 may be formed so as to perform an operation for making the front swing gear 61 mesh with the front intermediate gear 66 after an operation for making the rear swing gear 64 mesh with the rear intermediate gear 68, when changing the conveying direction of the intermediate transfer sheet 7 so that the conveying direction of the intermediate transfer sheet is inverted to the normal feed direction from the reverse feed direction.

That is, the front swing arm 60 and the rear swing arm 63 may be formed so as to perform an operation for making the rear swing gear 64 mesh with the rear intermediate gear 68 and then perform an operation for making the front swing gear 61 mesh with the front intermediate gear 66, when inverting the conveying direction of the intermediate transfer sheet 7 to the normal feed direction from the reverse feed direction.

Swing regulating members for regulating the swing ranges of the front swing arm 60 and the rear swing arm 63 may be provided for this operation so that, for example, the swing range of the front swing arm 60 is larger then that of the rear swing arm 63. Further, guide pins that are provided at the front and rear swing arms 60 and 63, respectively, and circular arc-shaped guide holes which are formed at a frame and into which these guide pins may be inserted may be used as the swing regulating members.

A front output gear 71, which meshes with the front intermediate gear 66, may be disposed on the left side of the front intermediate gear 66. The front output gear 71 may be mounted near the front end portion of the winding shaft 42.

A rear output gear 72, which meshes with the rear intermediate gear 68, may be disposed on the left side of the rear intermediate gear 68. The rear output gear 72 may be rotatably supported by the winding shaft 42. Further, a torque limiter 73 for reverse feed, which may be formed of a spring type torque limiter for applying back tension to the intermediate transfer sheet 7 during the reverse feed, may be mounted on the winding shaft 42. The torque limiter 73 for reverse feed may include an inner cylinder that may be mounted on the winding shaft 42 and may be rotated integrally with the winding shaft 42, an outer cylinder that may be engaged with the front end face of the rear output gear 72 and may be rotated integrally with the rear output gear 72, and a spring (coil spring) that may be interposed between the outer and inner cylinders.

The torque limiter 73 for reverse feed may be formed so that slip is generated between the inner cylinder rotated integrally with the winding shaft 42 and the outer cylinder of which the rotation is inhibited by the one-way clutch 69 during the reverse feed if torque applied to the winding shaft 42 exceeds previously set torque (set value) during the reverse feed; the slip torque (frictional torque) may be transmitted to the winding shaft 42 through the inner cylinder that is rotated while maintaining slip torque; and back tension can be applied to the intermediate transfer sheet 7. Further, the torque limiter 73 for reverse feed may be formed so that the drive force of the DC motor 16 is transmitted to the winding shaft 42 below the set torque during the normal feed.

Accordingly, the intermediate transfer medium conveying device 41 according to this embodiment may be formed so as to make the front swing gear 61 mesh with the front intermediate gear 66 after making the rear swing gear 64 mesh with the rear intermediate gear 68 and inputting the drive force of the DC motor 16 to the torque limiter 73 for reverse feed, when inverting the conveying direction of the intermediate transfer sheet 7 to the normal feed direction from the reverse feed direction.

That is, the intermediate transfer medium conveying device 41 according to this embodiment may be formed so as to make the front swing gear 61 mesh with the front intermediate gear 66 after making the rear swing gear 64 mesh with the rear intermediate gear 68 and transmitting the drive force of the DC motor 16 to the winding shaft 42 through the torque limiter 73 for reverse feed, when inverting the conveying direction of the intermediate transfer sheet 7 to the normal feed direction from the reverse feed direction.

The pinion 51, the main transmission gear 52, the worm gear 54 for normal feed, the worm wheel 56 for normal feed, the front branch gear 58, the front swing gear 61, the front intermediate gear 66, and the front output gear 71 form first transmission means 74 that directly transmits the drive force of the DC motor 16 of this embodiment to the winding shaft 42. The first transmission means 74 is formed of a gear train.

In this embodiment, the front swing arm 60 forms first connection/disconnection means 75 that may connect and disconnect the transmission of the drive force of the DC motor 16 so as to transmit the drive force of the DC motor 16 to the winding shaft 42 during the normal feed and blocks the drive force of the DC motor 16 during the reverse feed. Meanwhile, in this embodiment, the connection/disconnection of the drive force of the DC motor 16 during the reverse feed may be performed between the front swing gear 61 and the front intermediate gear 66.

The pinion 51, the main transmission gear 52, the worm gear 54 for normal feed, the worm wheel 56 for normal feed, the rear branch gear 59, the rear swing gear 64, the rear intermediate gear 68 mounted on the one-way clutch 69, the rear output gear 72, and the torque limiter 73 for reverse feed form second transmission means 76 that transmits the drive force of the DC motor 16 of this embodiment to the winding shaft 42 through the torque limiter 73 for reverse feed.

In this embodiment, the rear swing arm 63 may form second connection/disconnection means 77 that may connect and disconnect the transmission of the drive force of the DC motor 16 so as to transmit the drive force of the DC motor 16 to the winding shaft 42 during the normal feed and block the drive force of the DC motor 16 prior to the torque limiter 73 for reverse feed during the reverse feed. Meanwhile, in this embodiment, the connection/disconnection of the drive force of the DC motor 16 during the reverse feed may be performed between the rear swing gear 64 and the rear intermediate gear 68.

Accordingly, the transmission means 44 for normal feed of this embodiment may be formed so as to be capable of transmitting the drive force of the DC motor 16 to the winding shaft 42 through two transmission paths, that is, the first transmission means 74 and the second transmission means 76 and so as to transmit a drive force to the winding shaft 42 by the second transmission means 76 before transmitting a drive force to the winding shaft 42 by the first transmission means 74, when inverting the conveying direction of the intermediate transfer sheet 7 to the normal feed direction from the reverse feed direction.

Meanwhile, a pair of bevel gears, a one-way clutch, and a plurality of spur gears may be used alone or the combination thereof may be used instead of the worm gear 54 for normal feed and the worm wheel 56 for normal feed.

The transmission means 45 for reverse feed is for transmitting torque, which is the drive force of the DC motor 16, to the feeding shaft 43 during the reverse feed. The transmission means 45 for reverse feed may include a sun gear 81 that may be disposed on the right side of the intermediate gear 54*a* for normal feed. Meanwhile, the DC motor 16 may be driven in a direction, which is opposite to the direction of the DC motor during the normal feed, during the reverse feed.

The sun gear 81 may be rotatably supported by a sun gear support shaft 82. Further, the sun gear support shaft 82 may be disposed so that the axial direction is parallel to the upward/downward direction. The lower end portion of the sun gear support shaft 82 may be mounted on a frame (not shown). Furthermore, the sun gear 81 may be formed of a two-step gear including a lower gear 81*b*. The lower gear 81*b* may be formed at the lower end of an upper gear 81*a* always meshing with the intermediate gear 54*a* for normal feed so as to be coaxial with the upper gear 81*a*, has the same diameter as the diameter of the upper gear 81*a*, and may be rotated integrally with the upper gear 81*a*.

The base end portion of a right swing arm 83 may be rotatably supported below the lower end portion of the sun gear support shaft 82, and a planetary gear 84 meshing with the lower gear 81*b* of the sun gear 81 may be disposed above the tip portion of the right swing arm 83. The planetary gear 84 may be rotatably supported by a planetary gear support shaft 85. Moreover, the planetary gear support shaft 85 may be disposed so that the axial direction of the planetary gear support shaft is parallel to the upward/downward direction. The lower end portion of the planetary gear support shaft 85 is mounted near the tip portion of the right swing arm 83.

The planetary gear 84 may be formed so as to be capable of revolving around the sun gear support shaft 82 on the outer peripheral surface of the lower gear 81*b* as the sun gear 81 is rotated.

A worm gear 86 for reverse feed may be disposed on the right side of the sun gear 81. The worm gear 86 for reverse feed may be rotatably supported by a worm gear support shaft 87 for reverse feed. Further, the worm gear support shaft 87 for reverse feed may be disposed so that the axial direction of the worm gear support shaft for reverse feed is parallel to the upward/downward direction. The lower end portion of the worm gear support shaft 87 for reverse feed may be mounted on a frame (not shown). Furthermore, an intermediate gear 86*a* for reverse feed having a large diameter may be formed integrally with the lower end portion of the worm gear 86 for reverse feed. The sun gear 81 may be formed so as to be separated from the intermediate gear 86*a* for reverse feed during the normal feed and so as to mesh with the intermediate gear 86*a* for reverse feed during the reverse feed.

A worm wheel 88 for reverse feed may be disposed on the left side of the worm gear 86 for reverse feed. The worm wheel 88 for reverse feed may be rotatably supported substantially in the middle portion of a worm wheel support shaft 90 for reverse feed in the axial direction. Further, the worm wheel support shaft 90 for reverse feed may be disposed so that the axial direction of the worm wheel support shaft 90 for reverse feed is parallel to the forward/rearward direction. Both ends of the worm wheel support shaft 90 for reverse feed may be mounted on a frame (not shown).

A torque limiter 91 for normal feed, which may be formed of a spring type torque limiter for applying back tension to the intermediate transfer sheet 7 as an intermediate transfer medium during the normal feed, may be disposed at the front end portion of the worm wheel support shaft 90 for reverse feed. The same torque limiter as the torque limiter 73 for reverse feed may be used as the torque limiter 91 for normal feed. The torque limiter 91 for normal feed may include an inner cylinder that is mounted on the worm wheel support shaft 90 for reverse feed and is rotated integrally with the worm wheel support shaft 90 for reverse feed, and an outer cylinder that is engaged with the worm wheel 88 for reverse feed and is rotated integrally with the worm wheel 88 for reverse feed, and a spring (coil spring) that is interposed between the outer cylinder and the inner cylinder.

The torque limiter 91 for normal feed may be formed so that slip is generated between the inner cylinder connected to the feeding shaft 43 and the outer cylinder of which the rotation is inhibited by the worm gear 86 for reverse feed during the normal feed if torque applied to the feeding shaft 43 exceeds previously set torque during the normal feed; and the slip torque is transmitted to the feeding shaft 43, and eventually, the intermediate transfer sheet 7 through the inner cylinder as back tension. Further, the torque limiter 91 for normal feed may be formed so as to be capable of transmitting the drive force of the DC motor 16 to the feeding shaft 43 below the set torque during the reverse feed; and so as to be capable of applying front tension, which makes the set torque be a maximum value, to the feeding shaft 43, and eventually, the intermediate transfer sheet 7.

A reverse output gear 92 may be mounted at the rear end portion of the worm wheel support shaft 90 for reverse feed. A reverse drive gear 93, which may be mounted on the feeding shaft 43 and meshes with the reverse output gear 92, may be disposed on the upper left side of the worm wheel support shaft 90 for reverse feed.

In this embodiment, the sun gear 81 and the planetary gear 84 may form connection/disconnection means 94 for reverse feed. The connection/disconnection means 94 for reverse feed may transmit the drive force of the DC motor 16 to the worm gear 86 for reverse feed during the reverse feed, and may connect and disconnect the output of the DC motor 16 so that the drive force of the DC motor 16 is not transmitted to the worm gear 86 for reverse feed during the normal feed.

In this embodiment, the worm wheel 88 for reverse feed, the worm wheel support shaft 90 for reverse feed, the torque limiter 91 for normal feed, the reverse output gear 92, and the reverse drive gear 93 form third transmission means 95 that transmits the output of the worm gear 86 for reverse feed during the reverse feed to the feeding shaft 43 through the torque limiter 91 for normal feed for applying back tension to the intermediate transfer sheet 7 during the normal feed.

Meanwhile, the control of various operations, such as a transfer operation for transferring the ink of the multi-color ink sheet to the intermediate transfer sheet and a re-transfer operation for re-transferring the primary image to a medium to be transferred, is the same as that in the past. Accordingly, only an operation for inverting the conveying direction of the intermediate transfer sheet, which is within the scope of the invention, will be described below.

Further, the set torque of each of the torque limiter for reverse feed and the torque limiter for normal feed is previously set.

As shown in FIGS. 8 to 11, in a reverse feeding state where the conveying direction of the intermediate transfer sheet 7 conveyed by the intermediate transfer medium conveying device 41 according to this embodiment may be inverted to the reverse feed direction, the transmission means 45 for reverse feed receives a drive force that is generated by the drive of the DC motor 16; the planetary gear 84 of the connection/disconnection means 94 for reverse feed may mesh with the intermediate gear 86*a* for reverse feed; the drive force generated by the drive of the DC motor 16 may be transmitted to the feeding shaft 43 through the pinion 51, the main transmission gear 52, the connection/disconnection means 94 for reverse feed, the worm gear 86 for reverse feed, and the third transmission means 95 (the worm wheel 88 for reverse feed, the torque limiter 91 for normal feed, the worm wheel support shaft 90 for reverse feed, the reverse output gear 92, and the reverse drive gear 93) in this order; and the feeding shaft 43 is rotationally driven in a clockwise direction shown by a solid line arrow C of FIG. 8. Moreover, the intermediate transfer sheet 7 may be conveyed in a reverse direction by the drive force of the feeding shaft 43 so as to be unwound from the winding reel 15 and wound on the feeding reel 14. Here, the rotation direction of the output shaft 16*a* of the DC motor 16 that conveys the intermediate transfer sheet 7 in the reverse feed direction, and a voltage applied to the DC motor 16 that winds the intermediate transfer sheet 7 on the feeding shaft 43 are controlled by the control means 4. Further, the upper limit of the winding force of the feeding shaft 43, which winds the intermediate transfer sheet 7, may be determined by the previously set torque of the torque limiter 91 for normal feed.

Furthermore, as shown in FIG. 9, in the reverse feeding state, the transmission means 44 for normal feed receives a drive force generated by the drive of the DC motor 16; the front swing arm 60 of the first connection/disconnection means 75 is operated so that the front swing gear 59 is separated from the front output gear 71; and the rear swing arm 63 of the second connection/disconnection means 77 is operated so that the rear swing gear 64 is separated from the rear output gear 72.

That is, in the reverse feeding state, the first connection/disconnection means 75 and the second connection/disconnection means 77 block the output of the worm gear 54 for normal feed, that is, the drive force of the DC motor 16 so as not to transmit a drive force between the worm gear 54 for normal feed and the winding shaft 42, that is, between the front swing gear 59 and the front output gear 71 in this embodiment, and between the rear swing gear 64 and the rear output gear 72.

Accordingly, the state where the pinion 51 of the transmission means 44 for normal feed, the main transmission gear 52, the worm gear 54 for normal feed, the worm wheel 56 for normal feed, the front branch gear 58, and the rear branch gear 59 may be rotated in a direction opposite to the rotation direction of a normal feeding state are maintained in the reverse feeding state.

Further, in the reverse feeding state, the winding shaft 42 may be rotated by the rotational drive of the feeding shaft 43 in a direction opposite to the rotation direction of the feeding shaft 43, that is, in the counterclockwise direction shown by a broken line arrow of FIG. 8. In this embodiment, back tension may be applied to the intermediate transfer sheet 7 by the torque limiter 73 for reverse feed connected to the winding shaft 42. The rotation of the outer cylinder of the torque limiter 73 for reverse feed may be inhibited by the one-way clutch 69 where the outer ring is engaged with the inner ring during the reverse feed, so that the back tension applied by the torque limiter 73 for reverse feed is applied due to the slip generated between the outer and inner cylinders of the torque limiter 73 for reverse feed. Furthermore, the back tension may be determined by the previously set torque of the torque limiter 73 for reverse feed.

After that, the conveying direction of the intermediate transfer sheet 7 may be inverted to the normal feed direction from the reverse feed direction by the inversion of the rotation direction of the output shaft 16*a* of the DC motor 16. Meanwhile, the inversion of the rotation direction of the output shaft 16*a* of the DC motor 16 may be performed by a control command sent from the control means 4 after the rotation of the output shaft 16*a* of the DC motor 16 is stopped temporarily. In this case, the control means 4 controls the rotational speed of the output shaft 16*a* of the DC motor 16 by individually controlling a voltage applied to the DC motor 16 every time the transfer and re-transfer are performed.

Further, if the conveying direction of the intermediate transfer sheet 7 is inverted to the normal feed direction from the reverse feed direction, a drive force generated by the drive of the DC motor 16 is input to each of the second transmission means 76 and the first transmission means 74 of the transmission means 44 for normal feed.

In this case, the first transmission means 74 may receive the drive force generated by the drive of the DC motor 16; drives the front swing arm 60 as the first connection/disconnection means 75 so that the front swing gear 59 meshes with the front intermediate gear 66; and drives the rear swing arm 63 as the second connection/disconnection means 77 so that the rear swing gear 64 meshes with the rear intermediate gear 68.

That is, the first connection/disconnection means 75 may transmit the output of the worm gear 54 for normal feed so as to transmit a drive force between the front swing gear 59 and the front intermediate gear 66. Further, the second connection/disconnection means 77 may transmit the output of the worm gear 54 for normal feed so as to transmit a drive force among the rear swing gear 64, the rear intermediate gear 68, and the rear output gear 72.

In this case, after the rear swing gear 64 meshes with the rear intermediate gear 68, the front swing gear 61 may mesh with the front intermediate gear 66. Due to this operation, the drive force of the DC motor 16, which is output from the worm gear 54 for normal feed, may be transmitted to the winding shaft 42 by the first transmission means 74 after the drive force is transmitted to the winding shaft 42 by the second transmission means 76. That is, after receiving a drive force from the second transmission means 76, the winding shaft 42 may receive a drive force transmitted from the first transmission means 74.

Here, if a drive force is transmitted by the second connection/disconnection means 77 before a drive force is transmitted by the first connection/disconnection means 75 when the conveying direction of the intermediate transfer sheet 7 is inverted to the normal feed direction from the reverse feed direction, it may be possible to obtain advantages of maintaining the play of the torque limiter 73 for reverse feed in the same direction during the reverse feed and the normal feed and then preventing the generation of slack that is caused by the play of the torque limiter 73 for reverse feed during the reverse feed.

Accordingly, when the conveying direction of the intermediate transfer sheet 7 is inverted to the reverse feed direction from the normal feed direction later, slack is not generated on the intermediate transfer sheet 7 by the "play" of the torque limiter 73 for reverse feed.

Further, when the conveying direction of the intermediate transfer sheet 7 is inverted to the normal feed direction from the reverse feed direction, the drive force of the DC motor 16 may be transmitted to the winding shaft 42 by two transmission paths, that is, the first transmission means 74 and the second transmission means 76. Accordingly, if the drive force of the DC motor 16 transmitted to the winding shaft 42 exceeds the set torque of the torque limiter 73 for reverse feed, it may be possible to transmit the drive force of the DC motor 16 to the winding shaft 42 by the first transmission means 74. In this case, regardless of the set torque of the torque limiter 73 for reverse feed, the inner and outer cylinders of the torque limiter 73 for reverse feed are rotated integrally with each other in the same direction while being synchronized with each other.

Moreover, if the conveying direction of the intermediate transfer sheet 7 is inverted to the normal feed direction from the reverse feed direction, the transmission means 45 for reverse feed receives a drive force generated by the drive of the DC motor 16 and the planetary gear 84 of the connection/disconnection means 94 for reverse feed may be operated so as to be separated from the intermediate gear 86*a* for reverse feed that has meshed with the planetary gear 84 in the reverse feeding state. If the planetary gear 84 is separated from the intermediate gear 86*a* for reverse feed, the transmission of a drive force generated by the drive of the DC motor 16 may be blocked between the connection/disconnection means 94 for reverse feed and the worm gear 86 for reverse feed.

Further, as shown in FIGS. 4 to 7, in the normal feeding state of the intermediate transfer medium conveying device 41 according to this embodiment, the feeding shaft 43 may be rotated in the same direction as the rotation direction of the winding shaft 42 by the rotational drive of the winding shaft 42, and back tension may be applied to the intermediate transfer sheet 7 by the torque limiter 91 for normal feed connected to the feeding shaft 43.

Meanwhile, since the transmission means 45 for reverse feed has the structure where the torque limiter 91 for normal feed is disposed between the feeding shaft 43 and a driving gear train (the worm wheel 88 for reverse feed, the reverse output gear 92, and the reverse drive gear 93) connected to the worm gear 86 for reverse feed, the upper limit of the tension of the intermediate transfer sheet 7 during the reverse feed is determined by the torque limiter 91 for normal feed. However, in both a case where the intermediate transfer sheet is conveyed in the normal feed direction and a case where the intermediate transfer sheet is conveyed in the reverse feed direction, the play of the torque limiter 91 for normal feed is maintained in the same direction (a direction where a load is applied). Even when the conveying direction of the intermediate transfer sheet is inverted to the normal feed direction from the reverse feed direction, the slack of the intermediate transfer sheet 7 is not generated. Further, since transfer is not performed during the reverse feed, generally, there are many cases where torque does not need to be variable. However, if torque needs to be variable even during the reverse feed, an application that makes torque variable by using the structure of a portion between the feeding shaft 73 and the worm wheel 56 for normal feed of the transmission means 44 for normal feed of this embodiment as the structure of a reverse feed driving portion between the worm wheel 88 for reverse feed and the feeding shaft 43 also may be considered.

As described above, according to the second transmission means 76 of the intermediate transfer medium conveying device 41 of this embodiment, when the conveying direction of the intermediate transfer sheet 7 is inverted to the normal feed direction from the reverse feed direction, the drive force of the DC motor 16 is first input to the outer cylinder of the torque limiter 73 for reverse feed of the first transmission means 74. Accordingly, it may be possible to maintain a state where the "play" of the torque limiter 73 for reverse feed is removed in the same direction as the direction during the reverse feed and to rotationally drive the winding shaft 42 by transmitting the drive force of the DC motor 16 to the winding shaft 42 in a state where the inner and outer cylinders of the torque limiter 73 for reverse feed are rotated integrally with each other while being synchronized with each other. Therefore, afterward when the conveying direction of the intermediate transfer sheet 7 is inverted to the reverse feed direction from the normal feed direction, it may be possible to reliably and easily prevent slack from being generated on the intermediate transfer sheet 7.

That is, according to the intermediate transfer medium conveying device 41 of this embodiment, when the conveying direction of the intermediate transfer sheet 7 is inverted to the normal feed direction from the reverse feed direction, the second transmission means 76 may transmit the drive force of the DC motor 16 to the winding shaft 42 while removing the "play" of the torque limiter 73 for reverse feed in one direction. Accordingly, it may be possible to reliably and easily prevent slack from being generated on the intermediate transfer sheet 7 by the "play" of the torque limiter 73 for reverse feed.

Further, since the transmission means 45 for reverse feed of the intermediate transfer medium conveying device 41 according to this embodiment has the structure where the torque limiter 91 for normal feed is disposed between the feeding shaft 43 and a driving gear train (the worm wheel 88 for reverse feed, the reverse output gear 92, and the reverse drive gear 93) connected to the worm gear 86 for reverse feed, the upper limit of the tension of the intermediate transfer sheet 7 during the reverse feed may be determined by the torque limiter 91 for normal feed. However, in both a case where the intermediate transfer sheet is conveyed in the normal feed direction and a case where the intermediate transfer sheet is conveyed in the reverse feed direction, the play of the torque limiter 91 for normal feed is maintained in the same direction (a direction where a load is applied). Even when the conveying direction of the intermediate transfer sheet is inverted to the normal feed direction from the reverse feed direction, it may be possible to prevent slack from being generated on the intermediate transfer sheet 7.

Furthermore, according to the transmission means 44 for normal feed of the intermediate transfer medium conveying device 41 of this embodiment, when the conveying direction of the intermediate transfer sheet 7 is inverted to the normal feed direction from the reverse feed direction, the drive force of the DC motor 16 can be transmitted to the winding shaft 42 by two transmission paths, that is, the first transmission means 74 and the second transmission means 76. Accordingly, if the drive force of the DC motor 16 transmitted to the winding shaft 42 may exceed the set torque of the torque limiter 73 for reverse feed that forms a part of the second transmission means 76, it may be possible to transmit the drive force of the DC motor 16 to the winding shaft 42 by the first transmission means 74.

Therefore, according to the intermediate transfer medium conveying device 41 of this embodiment, since it may be possible to transmit the drive force of the DC motor 16 to the winding shaft 42 regardless of the previously set torque of the torque limiter 73 for reverse feed, it may be possible to change the rotational speed of the winding shaft 42, that is, the winding force of the winding shaft 42 for winding the intermediate transfer sheet 7 by changing a voltage applied to the DC motor 16.

That is, according to the intermediate transfer medium conveying device 41 of this embodiment, it may be possible to reliably and easily change the winding force of the winding shaft 42 for winding the intermediate transfer sheet 7 during the normal feed.

Accordingly, according to the intermediate transfer medium conveying device 41 of this embodiment, it may be possible to appropriately convey the intermediate transfer sheet 7.

According to the thermal transfer line printer 1 that includes the intermediate transfer medium conveying device 41 of this embodiment, slack is not generated on the intermediate transfer sheet 7 when the conveying direction of the intermediate transfer sheet 7 is inverted, and there is provided the control means 4 for controlling the voltages applied to the DC motor 16 during the transfer and re-transfer. Accordingly, it may be possible to individually, easily, and reliably control a winding force for winding the intermediate transfer sheet 7 during the transfer where ink is transferred to the intermediate transfer sheet 7, and a winding force for winding the intermediate transfer sheet during the re-transfer where a primary image is re-transferred to the medium 8 to be transferred.

Moreover, according to the thermal transfer line printer 1 that includes the intermediate transfer medium conveying device 41 of this embodiment, a voltage applied to the DC motor 16 during the re-transfer is set to be higher than a voltage applied to the DC motor 16 during the transfer. Accordingly, it may be possible to easily and reliably optimize a winding force for winding the intermediate transfer sheet 7 during the transfer where ink is transferred to the intermediate transfer sheet 7, and a winding force for winding the intermediate transfer sheet during the re-transfer where a primary image is re-transferred to the medium 8 to be transferred.

Therefore, according to the thermal transfer line printer 1 that includes the intermediate transfer medium conveying device 41 of this embodiment, it may be possible to appropriately convey the intermediate transfer sheet 7.

In addition, according to the thermal transfer line printer 1 that includes the intermediate transfer medium conveying device 41 of this embodiment, a slack removing mechanism provided in the thermal transfer line printer in the related art, for example, a tension applying shaft, and an adjusting mechanism for adjusting the parallelism of the tension applying shaft are not required. Accordingly, the structure of the printer becomes simple, so that it may be possible to achieve reduction in cost and weight.

Meanwhile, the invention is not limited to the above-mentioned embodiment, and may have various modifications according to needs.

For example, the intermediate transfer medium conveying device according to the invention may be employed as a conveying device when a belt-like recording medium such as roll paper is conveyed in the normal direction and reverse direction.

It should be understood by those skilled in the art that various modifications, combinations, sub-combinations and alterations may occur depending on design requirements and other factors insofar as they are within the scope of the appended claims of the equivalents thereof.

What is claimed is:

1. An intermediate transfer medium conveying device for conveying a belt-like intermediate transfer medium, which is wound between a winding reel and a feeding reel, by a drive force of one DC motor in a normal feed direction where the intermediate transfer medium is wound on the winding reel and in a reverse feed direction where the intermediate transfer medium is wound on the feeding reel, the intermediate transfer medium conveying device comprising:

a winding shaft that rotationally drives the winding reel during normal feed where the intermediate transfer medium is conveyed in the normal feed direction;

a feeding shaft that rotationally drives the feeding reel during reverse feed where the intermediate transfer medium is conveyed in the reverse feed direction;

transmission means for normal feed that transmits a drive force of the DC motor to the winding shaft during the normal feed, wherein during the normal feed, the drive force of the DC motor is transmitted to the winding shaft directly without a torque limiter; and transmission means for reverse feed that transmits a drive force of the DC motor to the feeding shaft during the reverse feed, wherein during the reverse feed, the drive force of the DC motor is not transmitted to the winding shaft, and the back tension is applied to the winding shaft by the torque limiter, wherein the transmission means for normal feed includes first transmission means and second transmission means, the first transmission means is formed so as to directly transmit a drive force of the DC motor to the winding shaft, the second transmission means is formed so as to transmit a drive force of the DC motor to the winding shaft through the torque limiter for reverse feed that applies back tension to the intermediate transfer medium during the reverse feed, the conveyance of the intermediate transfer medium in the normal feed direction and the conveyance of the intermediate transfer medium in the reverse feed direction are inverted to each other by the rotation direction of the DC motor, and a winding force, which is generated by the winding shaft when the intermediate transfer medium is wound on the winding reel, is changed by a voltage applied to the DC motor.

2. The intermediate transfer medium conveying device according to claim 1, wherein the first transmission means is provided with first connection/disconnection means that connects and disconnects the transmission of a drive force of the DC motor so as to transmit a drive force of the DC motor to the winding shaft during the normal feed and block a drive force of the DC motor during the reverse feed, the second transmission means is provided with second connection/disconnection means that connects and disconnects the transmission of a drive force of the DC motor so as to transmit a drive force of the DC motor to the winding shaft during the normal feed and block a drive force of the DC motor during the reverse feed prior to operation of the torque limiter for reverse feed, and the transmission means for normal feed is formed so that a drive force is transmitted by the second connection/disconnection means before a drive force is transmitted by the first connection/disconnection means when the conveying direction of the intermediate transfer medium is inverted to the normal feed direction from the reverse feed direction.

3. The intermediate transfer medium conveying device according to claim 1, wherein the transmission means for reverse feed includes a worm gear for reverse feed to which a drive force of the DC motor is input during the reverse feed, connection/disconnection means for reverse feed that connects and disconnects a drive force of the DC motor so that a drive force of the DC motor is transmitted to the worm gear for reverse feed during the reverse feed and a drive force of the DC motor is not transmitted to the worm gear for reverse feed during the normal feed, and third transmission means that transmits the output of the worm gear for reverse feed during the reverse feed to the feeding shaft through a torque limiter for normal feed for applying back tension to the intermediate transfer medium during the normal feed.

4. An intermediate transfer type thermal transfer line printer including an intermediate transfer medium conveying device for conveying a belt-like intermediate transfer medium, which is wound between a winding reel and a feeding reel, by a drive force of one DC motor in a normal feed direction where the intermediate transfer medium is wound on the winding reel and in a reverse feed direction where the intermediate transfer medium is wound on the feeding reel, forming a multicolored primary image by transferring ink of a multi-color ink sheet to the intermediate transfer medium, which is conveyed in the normal feed direction by the intermediate transfer medium conveying device, by a line thermal head, and forming a full color image on a medium to be transferred by re-transferring the primary image, which is formed on the intermediate transfer medium conveyed in the normal feed direction by the intermediate transfer medium conveying device, to a medium to be transferred by re-transfer means, the thermal transfer line printer comprising:

control means that controls voltages applied to the DC motor during transfer and re-transfer in order to individually control a winding force for winding the intermediate transfer medium during the transfer where ink is transferred to the intermediate transfer medium, and a winding force for winding the intermediate transfer medium during the re-transfer where the primary image is re-transferred to the medium to be transferred, wherein the intermediate transfer medium conveying device is the intermediate transfer medium conveying device according to claim 1.

5. The thermal transfer line printer according to claim 4, wherein a voltage applied to the DC motor during the re-transfer is set to be higher than a voltage applied to the DC motor during the transfer.

* * * * *